US011572220B2

(12) United States Patent
Tanaka et al.

(10) Patent No.: US 11,572,220 B2
(45) Date of Patent: Feb. 7, 2023

(54) PAPER LID

(71) Applicant: TOKAN KOGYO CO., LTD., Tokyo (JP)

(72) Inventors: Yusuke Tanaka, Tokyo (JP); Yoshito Hisatomi, Tokyo (JP); Taroh Monden, Tokyo (JP)

(73) Assignee: TOKAN KOGYO CO., LTD., Tokyo (JP)

( * ) Notice: Subject to any disclaimer, the term of this patent is extended or adjusted under 35 U.S.C. 154(b) by 0 days.

(21) Appl. No.: 17/052,521

(22) PCT Filed: Mar. 7, 2019

(86) PCT No.: PCT/JP2019/009100

§ 371 (c)(1),
(2) Date: Nov. 2, 2020

(87) PCT Pub. No.: WO2020/049769

PCT Pub. Date: Mar. 12, 2020

(65) Prior Publication Data

US 2021/0237945 A1 Aug. 5, 2021

(30) Foreign Application Priority Data

Sep. 4, 2018 (JP) ..... JP2018-165522

(51) Int. Cl.
*B65D 43/02* (2006.01)

(52) U.S. Cl.
CPC .... *B65D 43/0218* (2013.01); *B65D 2543/005* (2013.01); *B65D 2543/00046* (2013.01);
(Continued)

(58) Field of Classification Search
CPC ..... B65D 43/0218; B65D 5/14; B65D 2543/0049; B65D 2543/00268; B65D 2543/005
See application file for complete search history.

(56) References Cited

U.S. PATENT DOCUMENTS 2,074,325 A 3/1937 Herman
3,850,340 A 11/1974 Siemonsen et al.
(Continued)

FOREIGN PATENT DOCUMENTS

CN 1418743 A 5/2003
CN 1736698 A 2/2006
(Continued)

OTHER PUBLICATIONS

International Search Report (ISR) (and English translation thereof) dated Apr. 9, 2019 issued in International Application No. PCT/JP2019/009100.
(Continued)

*Primary Examiner* — Jeffrey R Allen
(74) *Attorney, Agent, or Firm* — Holtz, Holtz & Volek PC

(57) ABSTRACT

A paper lid that is mainly made of paper includes a top plate portion extending in a first direction, an inner fitting portion extending in a second direction and being continuous with the top plate portion, a peak portion extending in a third direction and being continuous with the inner fitting portion, an outer fitting portion extending in a fourth direction, facing the inner fitting portion at a distance, and being continuous with the peak portion, and a flange portion extending in a fifth direction, being continuous with the outer fitting portion, and including an end of the paper lid.

7 Claims, 16 Drawing Sheets

(52) U.S. Cl.
CPC ..... *B65D 2543/00092* (2013.01); *B65D 2543/00268* (2013.01); *B65D 2543/00537* (2013.01); *B65D 2543/00555* (2013.01)

(56) References Cited

U.S. PATENT DOCUMENTS

| | | | | |
|---|---|---|---|---|
| 5,904,643 | A | 5/1999 | Seeberger et al. | |
| 6,616,586 | B2 | 9/2003 | Dai | |
| 7,914,432 | B2 * | 3/2011 | Zelinski | B31B 70/00 493/143 |
| 8,900,505 | B2 | 12/2014 | Li et al. | |
| 10,368,668 | B2 | 8/2019 | Hyder et al. | |
| 10,889,412 | B2 | 1/2021 | West et al. | |
| 2005/0109653 | A1 | 5/2005 | Wnek et al. | |
| 2009/0173775 | A1 | 7/2009 | Swoboda et al. | |
| 2010/0243722 | A1 * | 9/2010 | Hyder | A47G 19/2272 229/125.02 |
| 2011/0193264 | A1 | 8/2011 | Li et al. | |
| 2015/0090776 | A1 | 4/2015 | Hyder et al. | |
| 2016/0000243 | A1 | 1/2016 | Tedford | |
| 2017/0305097 | A1 | 10/2017 | Räsänen et al. | |
| 2018/0086511 | A1 | 3/2018 | Lin | |
| 2021/0237387 | A1 | 8/2021 | Tanaka et al. | |

FOREIGN PATENT DOCUMENTS

| | | | |
|---|---|---|---|
| CN | 106335702 | A | 1/2017 |
| EP | 3845371 | A1 | 7/2021 |
| FR | 2102036 | A5 | 3/1972 |
| GB | 1298790 | A | 12/1972 |
| GB | 1567162 | A | 5/1980 |
| JP | S3310183 | Y1 | 7/1958 |
| JP | S47199 | U | 4/1972 |
| JP | S538276 | A | 1/1978 |
| JP | S584230 | A | 1/1983 |
| JP | S58136457 | U | 9/1983 |
| JP | S6346364 | U | 3/1988 |
| JP | H08156955 | A | 6/1996 |
| JP | 3080882 | U | 10/2001 |
| JP | 2002307578 | A | 10/2002 |
| JP | 2002307579 | A | 10/2002 |
| JP | 3432316 | B2 | 8/2003 |
| JP | 2004106918 | A | 4/2004 |
| JP | 2005104476 | A | 4/2005 |
| WO | 2010111237 | A1 | 9/2010 |
| WO | 2014110592 | A1 | 7/2014 |

OTHER PUBLICATIONS

Written Opinion dated Apr. 9, 2019 issued in International Application PCT/JP2019/009100.

International Search Report (ISR) (and English translation thereof) dated Oct. 1, 2019 issued in International Application No. PCT/JP2019/027475.

Related U.S. Appl. No. 17/052,517, First Named Inventor: Yusuke Tanaka; Title: "Paper Lid Production Method"; filed Nov. 2, 2020.

Written Opinion dated Oct. 1, 2019 issued in International Application PCT/JP2019/027475.

Chinese Office Action (and English language translation thereof) dated Dec. 13, 2021, issued in counterpart Chinese Application No. 201980034094.5.

Chinese Office Action (and English language translation thereof) dated Jan. 13, 2022, issued in Chinese Application No. 201980033986.3 (which is a counterpart of related U.S. Appl. No. 17/052,517).

Extended European Search Report dated Apr. 11, 2022, issued in counterpart European Application No. 19854916.4.

Extended European Search Report dated Jun. 1, 2022, issued in counterpart European Application No. 19857028.5.

Office Action (Non-Final) dated Jul. 7, 2022, issued in related U.S. Appl. No. 17/052,517.

* cited by examiner

FIG. 16A
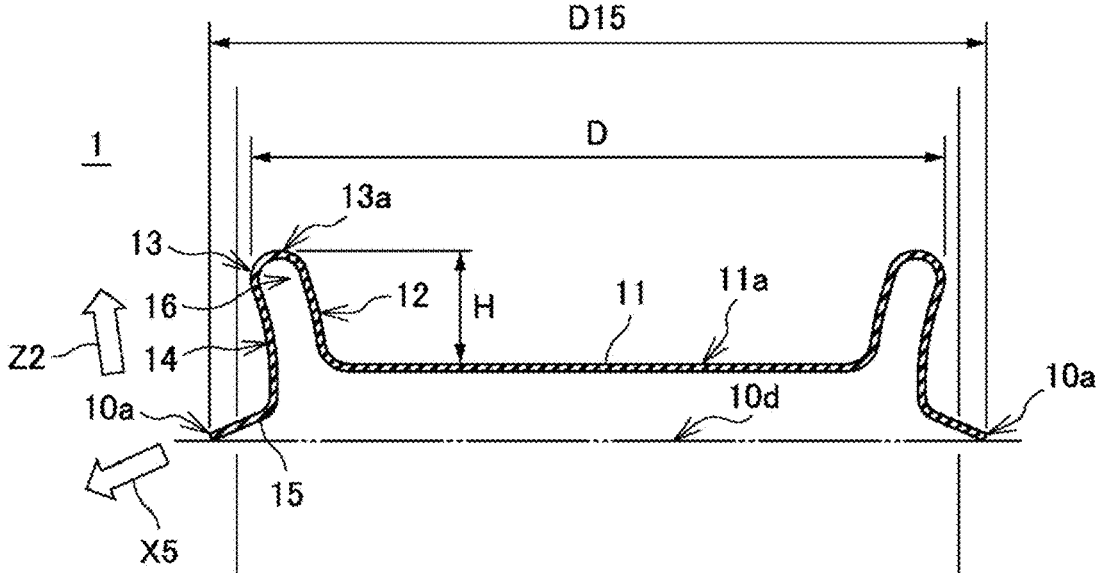
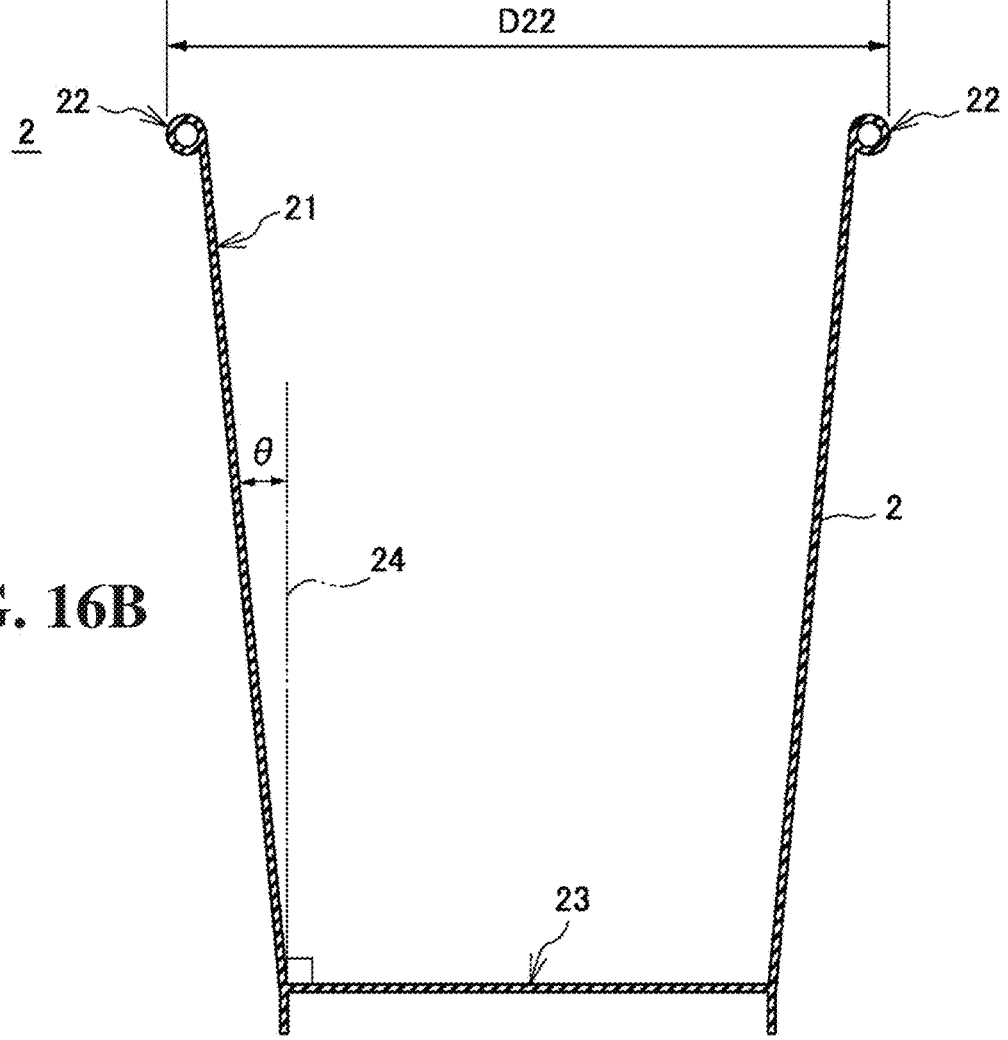
FIG. 16B

PAPER LID

TECHNICAL FIELD

The present invention relates to a paper lid.

BACKGROUND ART

A resin lid made of plastic or the like is used as a lid of a paper container such as a paper cup. However, when discarding this resin lid, it is necessary to separate it from the paper cup or the paper container, which is troublesome for the consumer.

Patent Document 1 discloses a paper lid having a top plate and a trapezoidal groove portion, which, provided in a peripheral portion of the top plate, consists of an outer wall, an upper wall and an inner wall, and which is open downward.

CITATION LIST

Patent Literature

Patent Literature 1: Japanese Patent No. 3432316

SUMMARY OF INVENTION

Problem to be Solved by the Invention

In Patent Literature 1, an outer edge portion of the container is fitted in the trapezoidal groove portion.

However, with a paper lid in which the outer edge portion of the container fits in a trapezoidal groove portion, the outer wall tends to expand outward. The inner wall corresponds to, for example, an inner fitting portion, and the outer wall corresponds to, for example, an outer fitting portion. Consequently, a circumstance arises in which a paper lid with both an inner fitting portion and an outer fitting portion is likely to come off the container.

The present invention has been made in view of the above circumstance, and it is therefore an object of the present invention to provide a paper lid that has both an inner fitting portion and an outer fitting portion, and that does not come off the container easily.

Means for Solving the Problem

The paper lid according to the first invention is a paper lid that is mainly made of paper, and this paper lid includes a top plate portion, extending in a first direction, an inner fitting portion, provided along a circumferential direction of the top plate portion, extending in a second direction, which intersects the first direction, and being continuous with the top plate portion, a peak portion, provided along the circumferential direction of the inner fitting portion, extending in a third direction, which intersects the second direction, and being continuous with the inner fitting portion, an outer fitting portion, provided along the circumferential direction of the peak portion, extending in a fourth direction, which intersects the third direction, facing the inner fitting portion at a distance, and being continuous with the peak portion, and a flange portion, provided along the circumferential direction of the outer fitting portion, extending in a fifth direction, which intersects the fourth direction, being continuous with the outer fitting portion, and including an end of the paper lid.

Based on the first invention, in the paper lid according to a second invention, the outer fitting portion has an inclined portion, in which at least a part of the outer fitting portion is inclined toward the inner fitting portion side.

Based on the first invention or the second invention, in the paper lid according to a third invention, an inner-surface side of the inner fitting portion has no wrinkles, at least within a range of 3 mm from the top plate portion.

Based on one of the first invention to the third invention, in the paper lid according to a fourth invention, the peak portion has wrinkles.

Based on one of the first invention to the fourth invention, in the paper lid according to a fifth invention, a tip of the flange portion has wrinkles.

Based on one of the first invention to the fifth invention, in the paper lid according to a sixth invention, proportion P of height H from a top surface of the top plate portion to a peak of the peak portion to an outer diameter D of the outer fitting portion ($P=(H/D)\times100\%$) is at least 6%.

Based on one of the first invention to the sixth invention, in the paper lid according to a seventh invention, in a sixth direction, which is orthogonal to the first direction, the top plate portion is located between the position of the peak portion and the position of the flange portion.

Advantageous Effects of Invention

With the paper lid according to the first invention, the paper lid has a flange portion, so that the outer fitting portion does not expand outward much, and therefore the paper lid can be prevented from coming off the container easily.

With the paper lid according to the second invention, an inclined portion, in which at least part of the outer fitting portion is inclined toward the inner fitting portion side, is provided, so that the paper lid can be fitted to the paper container even more firmly, compared to a paper lid without an inclined portion.

With the paper lid according to the third invention, the inner-surface side of the inner fitting portion has no wrinkles at least within a range of 3 mm from the top plate portion, so that it is possible to allow the paper lid and the container to fit together, without a gap, and prevent leakage of contents.

With the paper lid according to the fourth invention, the peak portion has wrinkles, so that, when molding the outer fitting portion, even if the blank is pulled in the fourth direction, the paper lid can be molded without having the blank being torn in the peak portion.

With the paper lid according to the fifth invention, the tip of the flange portion has wrinkles, so that it is possible to prevent hands and fingers from being cut by the end surface of the paper lid.

With the paper lid according to the sixth invention, if the proportion P of the height H to the outer diameter D ($P=(H/D)\times100\%$) is at least 6%, the top surface side of the inner fitting portion contacts the inner surface of the container, so that, even when the container falls, it is still possible to prevent leakage of contents.

With the paper lid according to the seventh invention, the top plate portion located between the position of the peak portion and the position of the flange portion in the sixth direction, so that, even if the paper lid is placed, for example, on a table, the container-side surface of the top plate portion does not contact the table surface. This paper lid is hygienic.

BRIEF DESCRIPTION OF DRAWINGS

FIGS. 10A to 10D are schematic cross-sectional views to show examples of the method for producing a paper lid according to one embodiment of this invention;

FIG. 16A is a schematic cross-sectional view to show an example of a paper lid according to one embodiment of this invention;

FIG. 16B is a schematic cross-sectional view to show a paper container that can fit an example of a paper lid according to one embodiment of this invention.

DESCRIPTION OF EMBODIMENTS

Hereinafter, one embodiment of this invention will be described with reference to the accompanying drawings.

(Paper Lid)

Figure 1A:
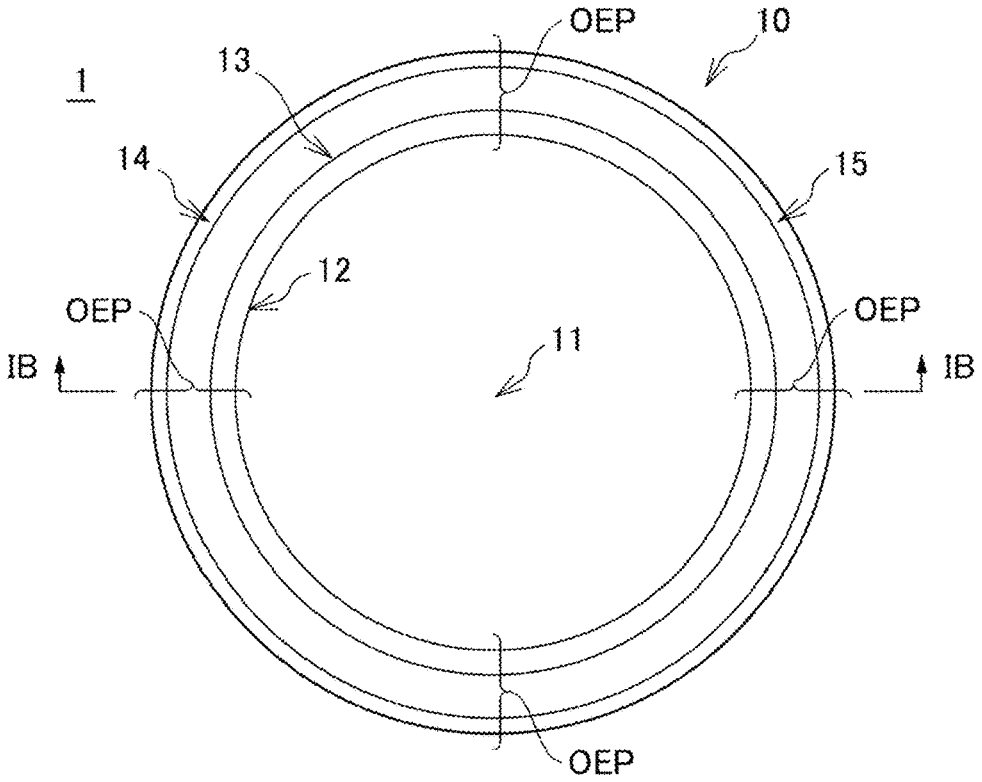
FIG. 1A is a schematic plan view to show an example of a paper lid according to one embodiment of this invention.
Figure 1B:
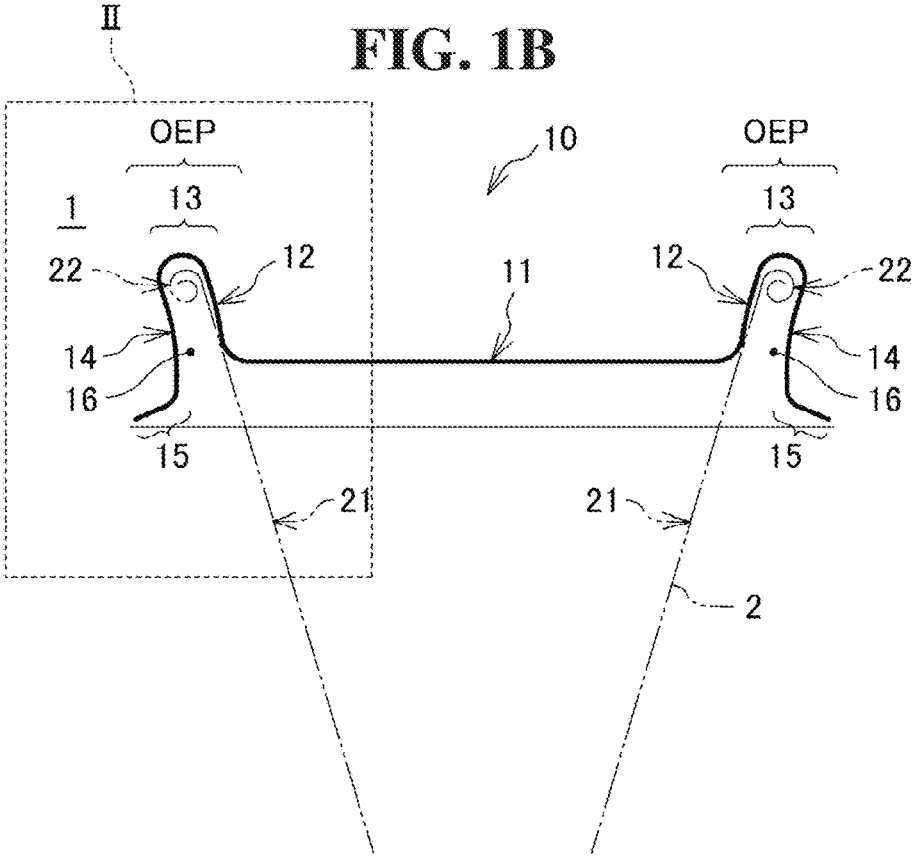
FIG. 1B is a schematic cross-sectional view taken along the line IB-IB in FIG. 1A.
Figure 2:
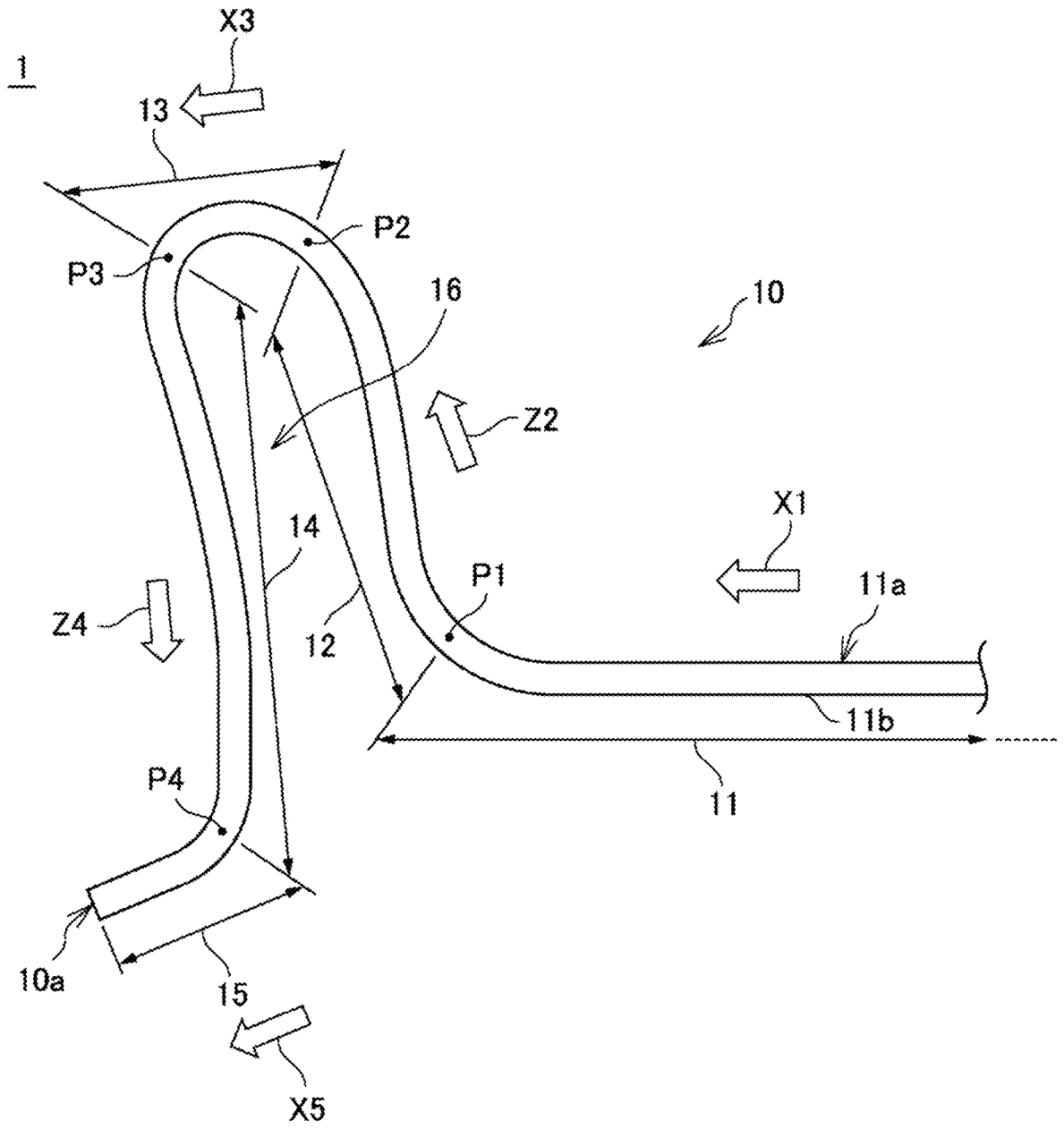
FIG. 2 is a schematic cross-sectional view to show an enlarged view of the broken-line frame II in FIG. 1A.

FIG. 1A is a schematic plan view to show an example of a paper lid according to one embodiment of this invention, and FIG. 1B is a schematic cross-sectional view taken along the line IB-IB in FIG. 1A. FIG. 2 is a schematic cross-sectional view to show an enlarged view of the broken-line frame II in FIG. 1A.

As shown in FIG. 1A, FIG. 1B, and FIG. 2, a paper lid 1 is formed with a blank 10 mainly made of paper, and includes a top plate portion 11, an inner fitting portion 12, a peak portion 13, an outer fitting portion 14, and a flange portion 15. The shape of the paper lid 1 in plan view is, for example, a circle.

The top plate portion 11 extends in the first direction X1. The top plate portion 11 has a top surface 11*a* and a container-side surface 11*b*. The container-side surface 11*b* is on the back surface of the top surface 11*a*. The container-side surface 11*b* faces the container portion of the paper container 2 when the paper lid 1 fits with the paper container 2.

The inner fitting portion 12 is provided in an outer edge portion OEP of the paper lid 1, along the circumferential direction of the top plate portion 11. The inner fitting portion 12 extends in a second direction Z2, which intersects the first direction X1, and is continuous with the top plate portion 11.

The peak portion 13 is provided on the outer edge portion OEP, along the circumferential direction of the inner fitting portion 12. The peak portion 13 extends in a third direction X3, which intersects the second direction Z2, and is continuous with the inner fitting portion 12. In the embodiment herein, the peak portion 13 includes a curved surface that is convex in the second direction Z2 in its cross section.

The outer fitting portion 14 is provided in the outer edge portion OEP, along the circumferential direction of the peak portion 13. The outer fitting portion 14 extends in a fourth direction Z4, which intersects the third direction X3, and is continuous with the peak portion 13. The outer fitting portion 14 faces the inner fitting portion 12 at a distance. Below the peak portion 13, an annular recess portion 16, having both the inner fitting portion 12 and the outer fitting portion 14 as surrounding walls, and having the peak portion 13 at the bottom, is provided between the inner fitting portion 12 and the outer fitting portion 14. The container (for example, the paper container 2) fits in the annular recess portion 16. The paper container 2 is, for example, a paper cup. The inner fitting portion 12 fits the inner peripheral surface 21 of the container portion of the paper container 2, and the outer fitting portion 14 fits the outer peripheral surface of the curl portion 22 of the paper container 2.

The flange portion 15 is provided in the outer edge portion OEP, along the circumferential direction of the outer fitting portion 14. The flange portion 15 extends in a fifth direction X5, which intersects the fourth direction Z4, and is continuous with the outer fitting portion 14. The flange portion 15 includes the end 10*a* of the paper lid 1.

Referring to the cross section of paper lid 1, the paper lid 1 bends in the second direction Z2 in the inner fitting portion 12, bends in the third direction X3 in the peak portion 13, bends in the fourth direction Z4 in the outer fitting portion 14, and bends in the fifth direction X5 in the flange portion 15. That is, the inner fitting portion 12, the peak portion 13, the outer fitting portion 14, and the flange portion 15 are all made from one blank 10.

Given this shape of the paper lid 1, if the boundary between the top plate portion 11 and the inner fitting portion 12, the boundary between the inner fitting portion 12 and the peak portion 13, the boundary between the peak portion 13 and the outer fitting portion 14 and the boundary between the outer fitting portion 14 and the flange portion 15 are to be demarcated, for example, these boundaries may be found at the inflection points of the blank 10, or in the vicinity of the inflection points.

For example, assume that the blank 10 is subjected to drawing molding, and the top plate portion 11, the inner fitting portion 12, the peak portion 13, the outer fitting portion 14, and the flange portion 15 are formed in the blank 10. In this case, as shown in FIG. 2, for example, the boundary between the top plate portion 11 and the inner fitting portion 12 can be an inflection point P1, which is produced where the blank 10 is bent (squeezed) from the first direction X1 to the second direction Z2. By this means, the top plate portion 11 is defined to last from the inflection point P1 on the opposite side (not shown in FIG. 2) to the inflection point P1 shown in FIG. 2.

Likewise, the boundary between the inner fitting portion 12 and the peak portion 13 can be an inflection point P2, which is produced where the blank 10 is bent (squeezed) from the second direction Z2 to the third direction X3. By this means, the inner fitting portion 12 is defined to last from the inflection point P1 to the inflection point P2.

Likewise, the boundary between the peak portion 13 and the outer fitting portion 14 can be an inflection point P3, which is produced where the blank 10 is bent (squeezed) from the third direction X3 to the fourth direction Z4. By this means, the peak portion 13 is defined to last from the inflection point P2 to the inflection point P3.

Likewise, the boundary between the outer fitting portion 14 and the flange portion 15 can be an inflection point P4, which is produced where the blank 10 is bent (squeezed) from the fourth direction Z4 to the fifth direction X5. By this means, the outer fitting portion 14 is defined to last from the inflection point P3 to the inflection point P4. The flange portion 15 is defined to last from the inflection point P4 to the end 10*a*.

Figure 3A:
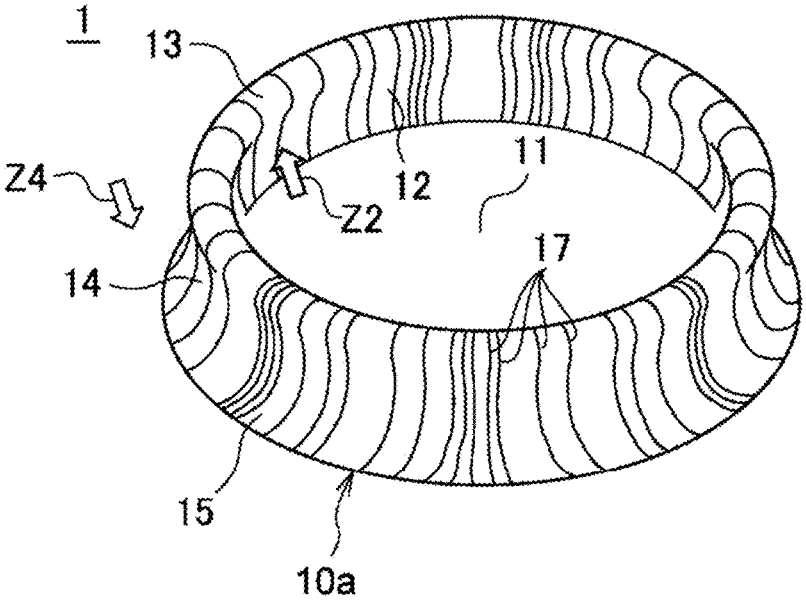
FIG. 3A is a schematic perspective view to show an example of a paper lid according to one embodiment of this invention.
Figure 3B:
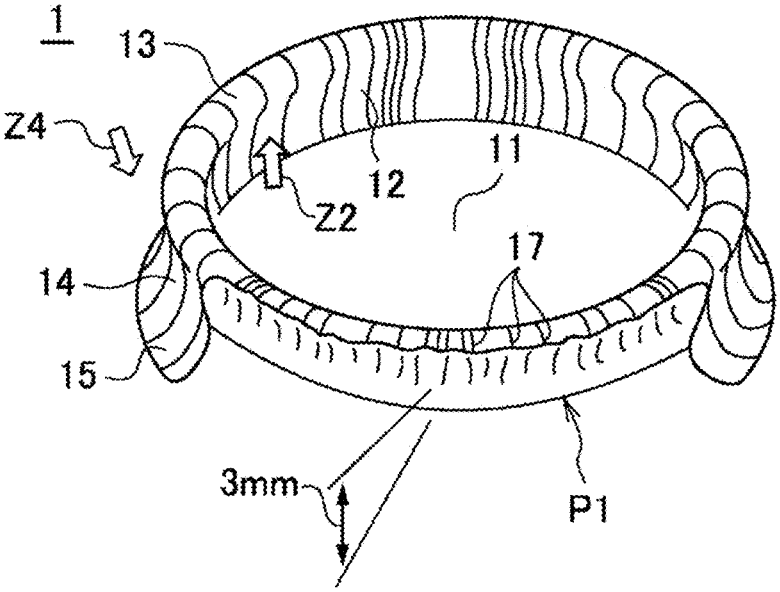
FIG. 3B is a schematic perspective view, showing part of the schematic perspective view shown in FIG. 3A cut out.

FIG. 3A is a schematic perspective view to show an example of a paper lid according to one embodiment of this invention. FIG. 3B is a schematic perspective view, showing part of the schematic perspective view shown in FIG. 3A cut out.

As shown in FIGS. 3A and 3B, the inner surface of the inner fitting portion 12 of the paper lid 1 has no wrinkles 17, at least within a range of 3 mm from the top plate portion 11 (specifically, the boundary between the inner fitting portion 12 and the top plate portion 11 (inflection point P1)) in the second direction Z2, and has wrinkles 17 from 3 mm and beyond. By this means, there are no wrinkles 17 in the inner surface of the inner fitting portion 12 contacting the inner peripheral surface 21 of the container portion of the paper container 2. Consequently, when the paper lid 1 fits with the paper container 2, a gap that might cause leakage of contents is no longer produced between the inner peripheral surface 21 of the container portion of the paper container 2 and the inner surface of the inner fitting portion 12. It then follows that leakage of contents can be prevented. On the other hand, wrinkles 17 are present on the outer surface of the inner fitting portion 12.

Furthermore, the peak portion 13 has many fine wrinkles 17 on both the inner surface and the outer surface. By this means, even if the blank 10 is pulled in the fourth direction Z4 (direction opposite to the second direction Z2) when molding the outer fitting portion 14, the wrinkles 17 on the outer surface of the peak portion 13 serve as margins to smooth out, so that the paper lid 1 can be molded without having the blank 10 being torn in the peak portion 13.

Furthermore, the outer fitting portion 14 has many fine wrinkles 17 on both the inner surface and the outer surface.

Furthermore, the flange portion 15 has many fine wrinkles 17 on both the inner surface and the outer surface.

Figure 4A:
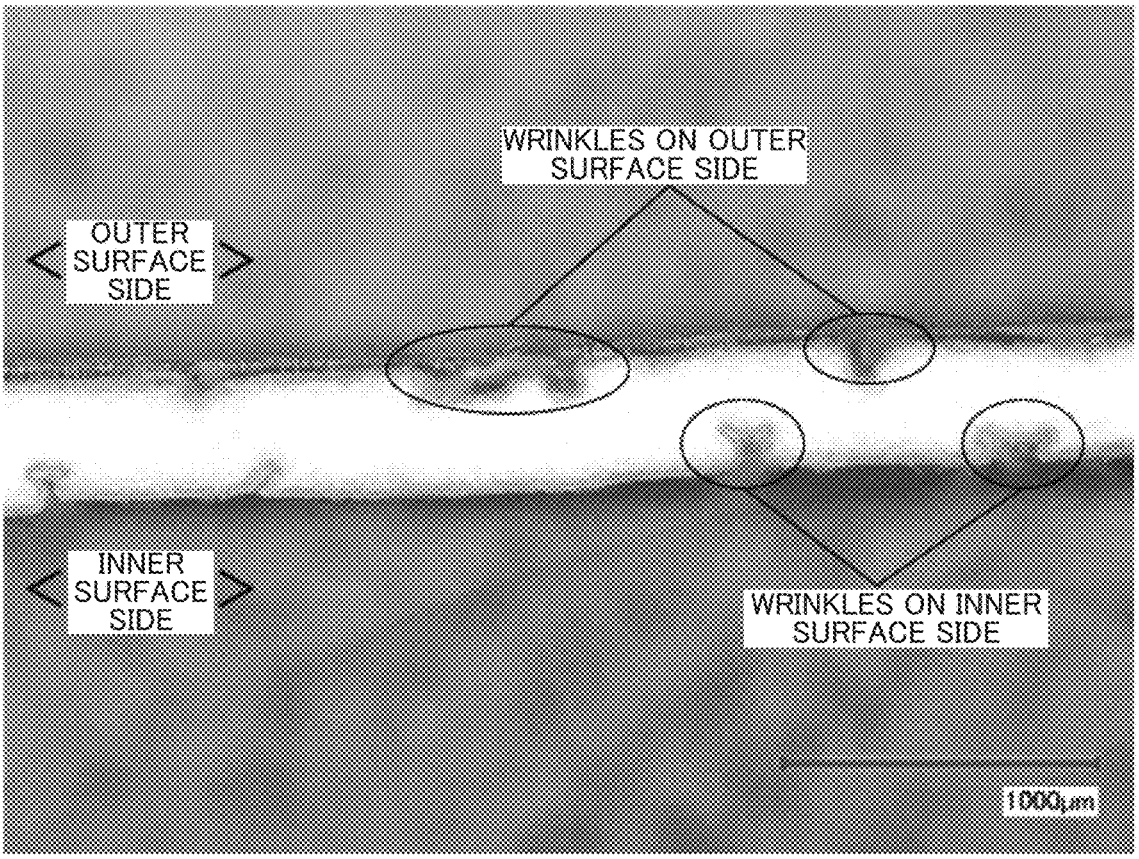
FIG. 4A is a drawing-substituting photograph to show the end of the flange portion.
Figure 4B:
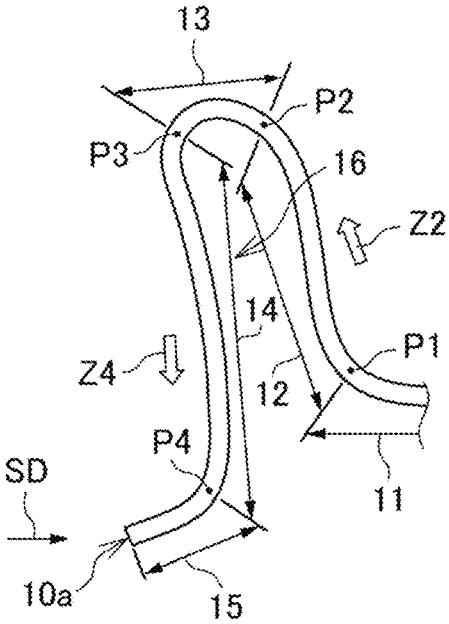
FIG. 4B is a schematic cross-sectional view to show the direction in which the drawing-substituting photograph shown in FIG. 4A is taken.
Figure 5A:
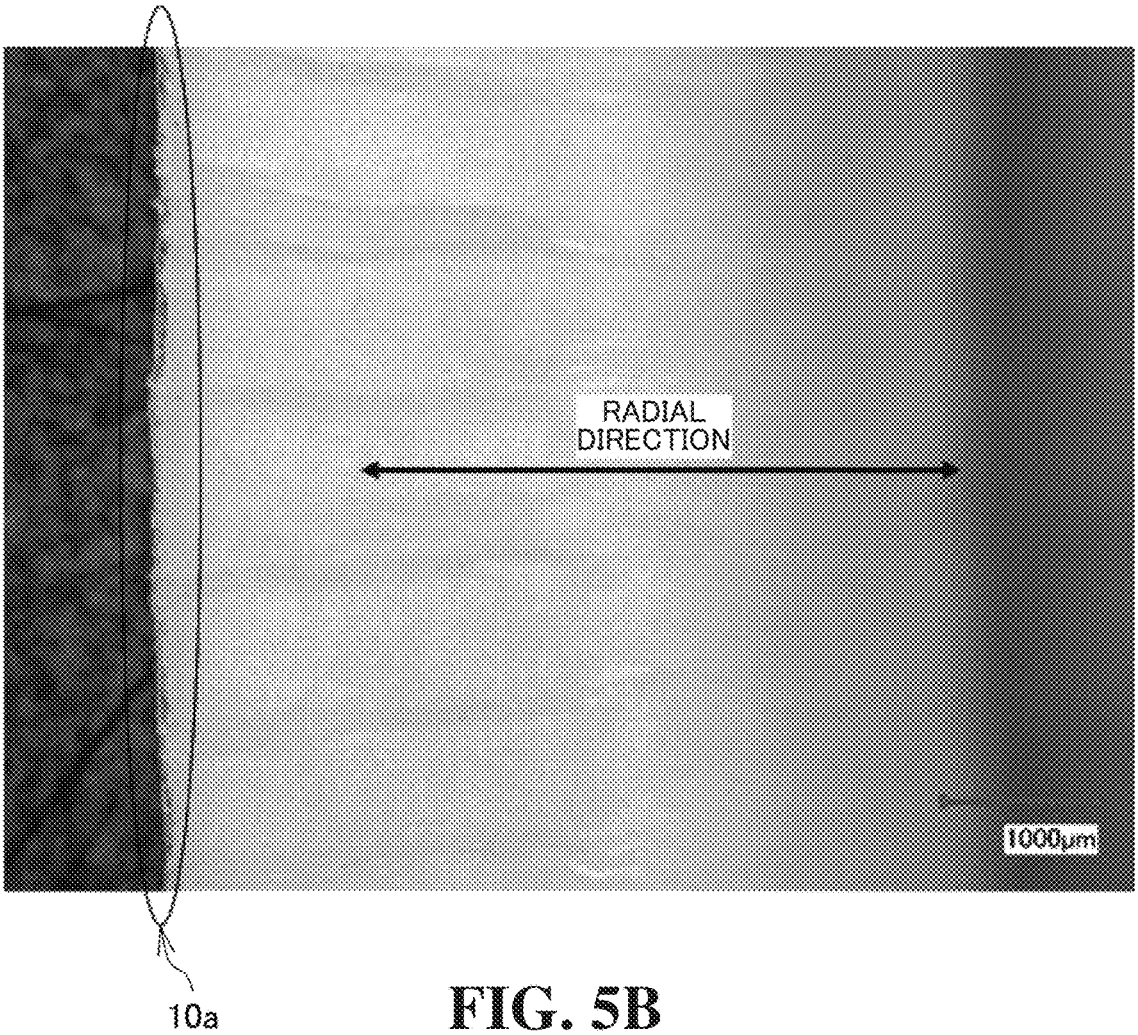
FIG. 5A is a drawing-substituting photograph to show the outer surface of the flange portion.
Figure 5B:
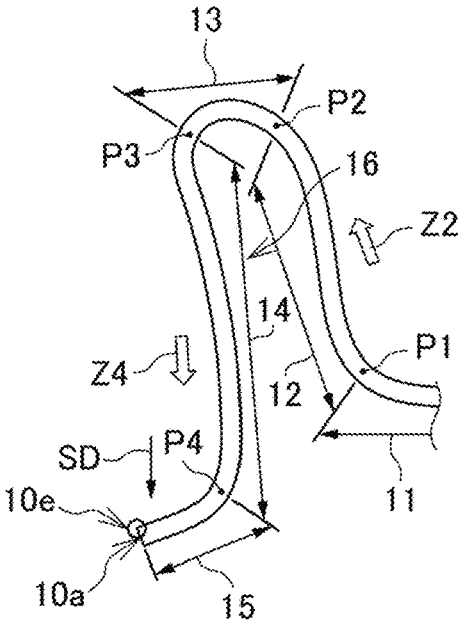
FIG. 5B is a schematic cross-sectional view to show the direction in which the drawing-substituting photograph shown in FIG. 5A is taken.

FIG. 4A is a drawing-substituting photograph to show the end of the flange portion 15. FIG. 4B is a schematic cross-sectional view to show the direction in which the drawing-substituting photograph shown in FIG. 4A is taken. FIG. 5A is a drawing-substituting photograph to show the outer surface of the flange portion 15. FIG. 5B is a schematic cross-sectional view to show the direction in which the drawing-substituting photograph shown in FIG. 5A is taken.

FIG. 4A shows the appearance of the end 10*a* of the flange portion 15, as taken from the shooting direction SD shown in FIG. 4B. The flange portion 15 has wrinkles 17 in different positions between the outer-surface side and the inner-surface side. That is, between two adjacent wrinkles 17 on the outer-surface side, there is one wrinkle 17 on the inner-surface side, and, between two adjacent wrinkles 17 on the inner-surface side, there is one wrinkle 17 on the outer-surface side.

Furthermore, FIG. 5A shows the appearance of the outer surface of the flange portion 15, as taken from the shooting direction SD shown in FIG. 5B. The end 10*a* of the paper lid 1 is shaped with bumps and dents in the radial direction, and the corner portion 10*e* of the end 10*a* of the paper lid 1 is also shaped to have bumps and dents. By this means, it is possible to provide a safe paper lid 1, whereby hands and fingers are not cut when they trace the end 10*a*.

Figure 6A:
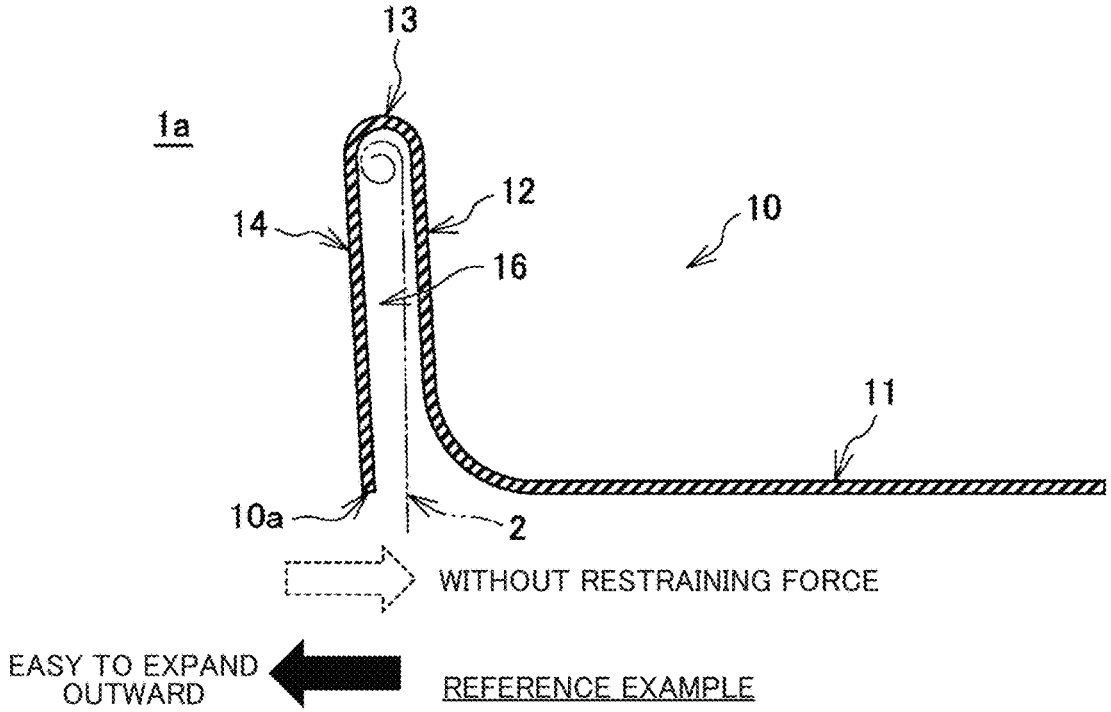
FIG. 6A is a schematic cross-sectional view to show a paper lid according to a reference example.
Figure 6B:
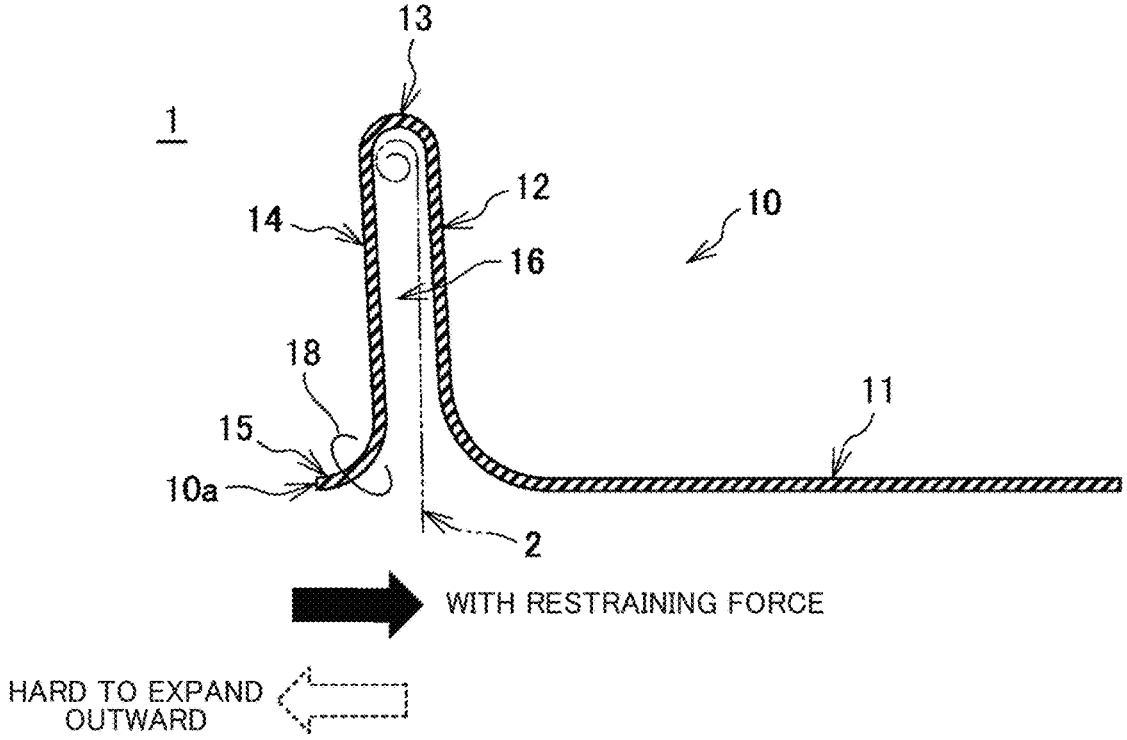
FIG. 6B is a schematic cross-sectional view to show an example of a paper lid according to one embodiment of this invention.

FIG. 6A is a schematic cross-sectional view to show a paper lid according to a reference example. FIG. 6B is a schematic cross-sectional view to show an example of a paper lid according to one embodiment of this invention. The cross sections shown in FIGS. 6A and 6B correspond to the cross section shown in FIG. 2, for example.

As shown in FIG. 6A, in the paper lid 1*a* according to the reference example, the outer fitting portion 14 includes the end 10*a* of the paper lid 1*a*. That is, the paper lid 1*a* has no flange portion 15. The end 10*a* is a free end. Consequently, a force to try to resume the original shape acts on the outer fitting portion 14 due to the residual stress, which facilitates the outer fitting portion 14 to expand outward. It then follows that the paper lid 1*a* comes off the paper container 2 easily.

As shown in FIG. 6B, the paper lid 1 according to one embodiment has a flange portion 15, and the flange portion 15 includes an end 10*a*. The end 10*a* is a free end as in the reference example. However, in the paper lid 1, a shoulder portion 18 is present, from the outer fitting portion 14 to the flange portion 15, throughout the circumferential direction. The shoulder portion 18 is, for example, squeezed and contracted. A force to try to stay in that shape acts on the contracted shoulder portion 18, which gives a restraining force against the force of the outer fitting portion 14 to try to resume the original shape. Furthermore, the flange portion 15 of the paper lid 1 has wrinkles 17, which are compressed and crushed more by the effect of wrinkle prevention. Given the wrinkles 17, a force to try to stay in this shape acts on the flange portion 15. Furthermore, given that the flange portion 15 is provided along the entire circumferential direction, a force to fix the entire circumference is produced, and acts as a restraining force against the force of the outer fitting portion 14 trying to resume the original shape. It then follows that the paper lid 1 does not expand outward much, and does not come off the paper container 2 easily, compared to the paper lid 1*a*.

Also, even if the paper container 2 fits in the annular recess portion 16, and the outer fitting portion 14 expands outward temporarily, the shoulder portion 18, which is squeezed, has a stronger tendency to resume the shape after the molding than the end 10*a* of the paper lid 1*a*. Consequently, unlike the paper lid 1*a*, the paper lid 1 does not lose much of its fitting strength even after the paper lid 1 repeats being attached to and detached from the paper container 2.

Since the paper lid 1 has both the inner fitting portion 12 and the outer fitting portion 14, the paper lid 1 can fit with the paper container 2 even more firmly, compared to a paper lid with the inner fitting portion 12 alone or the outer fitting portion 14 alone. Furthermore, since the paper lid 1 has the flange portion 15, the paper lid 1 does not come off the paper container 2 easily, compared to a paper lid without the flange portion 15.

Next, an example of the method for producing a paper lid will be described.

(Paper Lid Producing Method)

<Example of Processing Machine>

Figure 7:
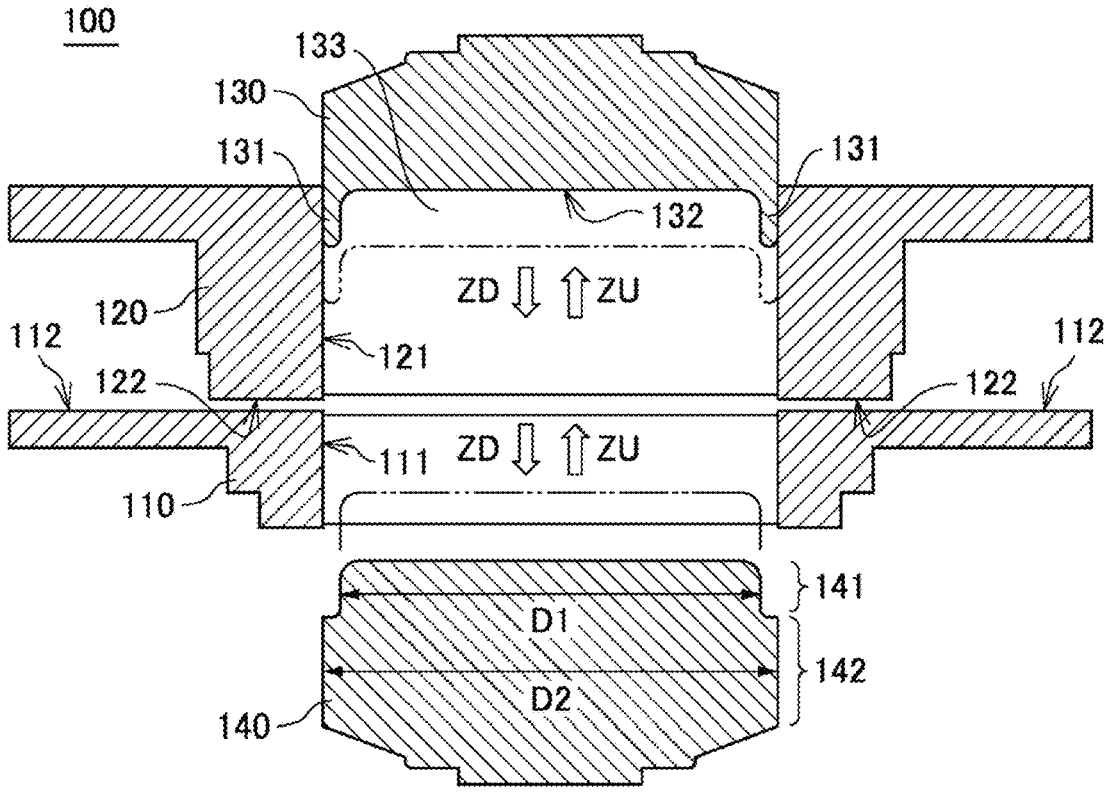
FIG. 7 is a schematic cross-sectional view to show an example of a processing machine that can be used to produce a paper lid according to one embodiment of this invention.

FIG. 7 is a schematic cross-sectional view to show an example of a processing machine that can be used to produce a paper lid according to one embodiment of this invention.

A processing machine 100 includes a draw die 110, a blank holder 120, a draw punch 130, and a plunger 140.

The draw die 110 has a plunger guide hole 111 and a mounting surface 112. The plunger guide hole 111 is, for example, a circular hole. The mounting surface 112 is provided outside the plunger guide hole 111. The mounting surface 112 faces the blank holder 120. The mounting surface 112 is a surface on which the blank 10 can be mounted.

The blank holder 120 has a punch guide hole 121 and a pressing surface 122. The punch guide hole 121 is a circular hole. The pressing surface 122 is provided outside the punch guide hole 121. The pressing surface 122 faces the mounting surface 112. The blank holder 120 holds down the blank 10 laid on the mounting surface 112.

The draw punch 130 can move in the punch guide hole 121 in both the upward direction ZU and the downward direction ZD. The upward direction ZU and the downward direction ZD both intersect (for example, are orthogonal to) the mounting surface 112. The downward direction ZD is opposite to the upward direction ZU. An annular protrusion portion 131 is provided in a tip part of the draw punch 130. The annular protrusion portion 131, for example, protrudes like a surrounding wall from the punch surface 132 of the draw punch 130. By this means, a depression 133, which is surrounded by the annular protrusion portion 131, and which has the punch surface 132 at the bottom, is formed in the tip part of the draw punch 130. The annular protrusion portion 131 can be fitted to the inner peripheral surface of the plunger guide hole 111 with a clearance. The tip of the annular protrusion portion 131 has a curved surface.

The plunger 140 can move in the plunger guide hole 111 in both the upward direction ZU and the downward direction ZD. A reduced-diameter portion 141 is provided in the tip part of the plunger 140. The diameter D1 of the reduced-diameter portion 141 is smaller than the diameter D2 of the base diameter portion 142 of the plunger 140. The reduced-diameter portion 141 can be fitted to the annular protrusion portion 131 with a clearance.

The processing machine 100 is, for example, a press machine. For example, by using the processing machine 100 shown in FIG. 7, the paper lid 1 having both the inner fitting portion 12 and the outer fitting portion 14 can be produced from the blank 10.

FIG. 8, FIGS. 9A to 9D and FIGS. 10A to 10D are schematic cross-sectional views to show examples of the method for producing a paper lid according to one embodiment of this invention. FIG. 8, FIGS. 9A to 9D, and FIGS. 10A to 10D show schematic cross sections of the blank 10 and schematic cross sections of the processing machine 100, respectively.

Figure 8:
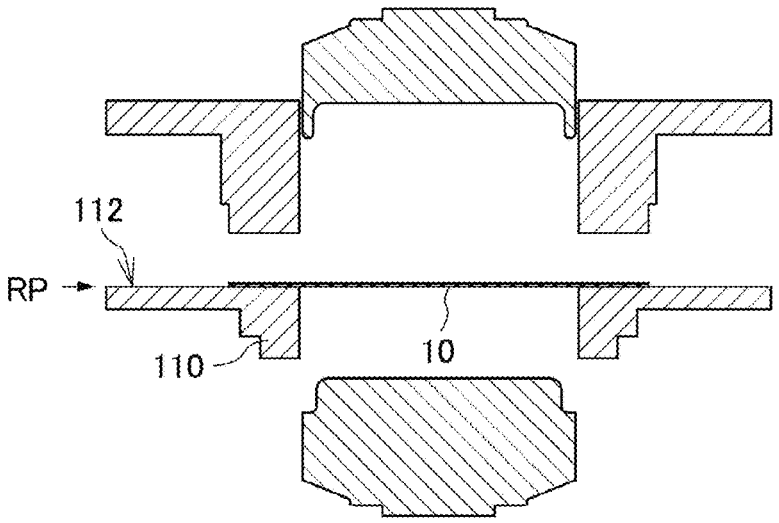
FIG. 8 is a schematic cross-sectional view to show an example of the method for producing a paper lid according to one embodiment of this invention.

As shown in FIG. 8, the blank 10 is laid on the mounting surface 112 of the draw die 110. Note that, in the following description, the position of the mounting surface 112 serves as a reference position RP.

Figure 9A:
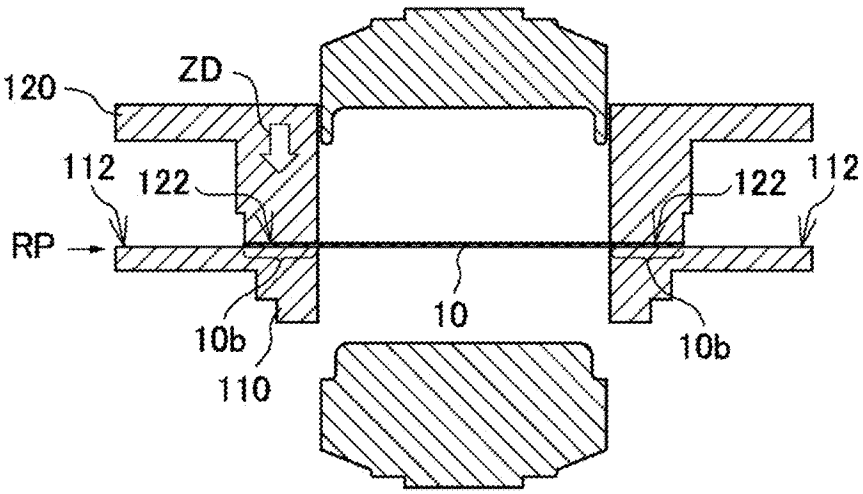
FIGS. 9A to 9D are schematic cross-sectional views to show examples of the method for producing a paper lid according to one embodiment of this invention.

Next, as shown in FIG. 9A, the blank holder 120 is moved in the downward direction ZD, and the outer edge area 10*b* of the blank 10 is held down by the pressing surface 122 of the blank holder 120.

Figure 11A:
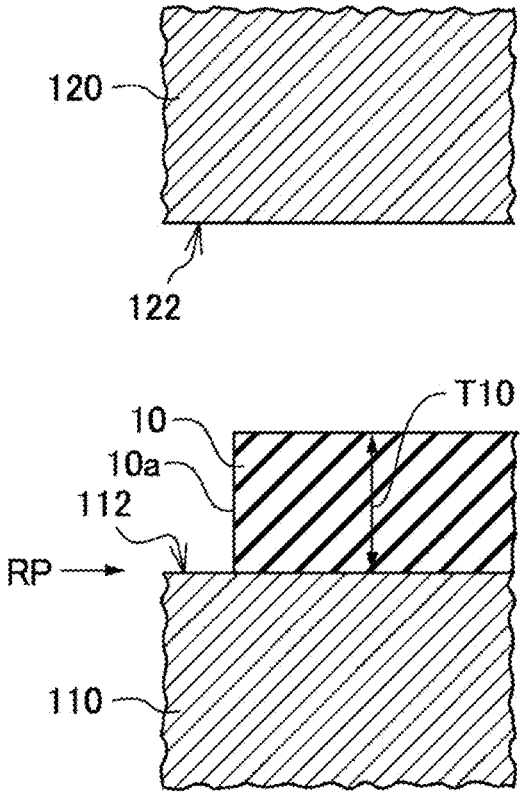
FIGS. 11A and 11B are schematic cross-sectional views to show partially enlarged views of a mounting surface and a pressing surface, respectively.
Figure 11B:
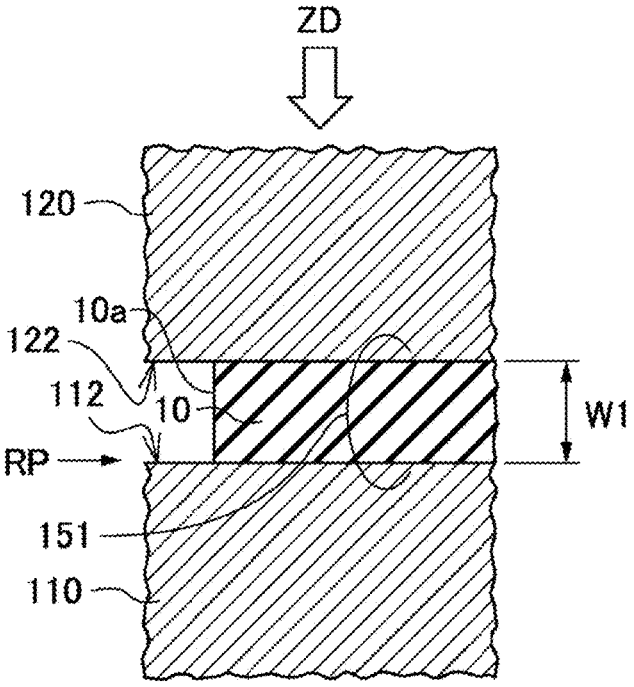

FIGS. 11A and 11B are schematic cross-sectional views to show partially enlarged views of the blank 10, the draw die, and the blank holder, respectively. FIG. 11A shows a state in which the blank 10 is laid on the mounting surface 112, and FIG. 11B shows a state in which the outer edge area 10*b* is held down by the pressing surface 122.

As shown in FIG. 11B, when the blank 10 is held down by the pressing surface, a first clearance 151 is formed between the mounting surface 112 and the pressing surface 122. The width W1 of the first clearance 151 is set smaller than the paper thickness T10 of the blank 10 (FIG. 11A). By this means, the blank 10 is crushed, and "wrinkle prevention" can be applied to the blank 10. Note that the blank holder 120 may be given a load for "wrinkle prevention", and the width W1 of the first clearance may be equal to the paper thickness T10 of the blank 10, or may be greater than the paper thickness T10.

Figure 9B:
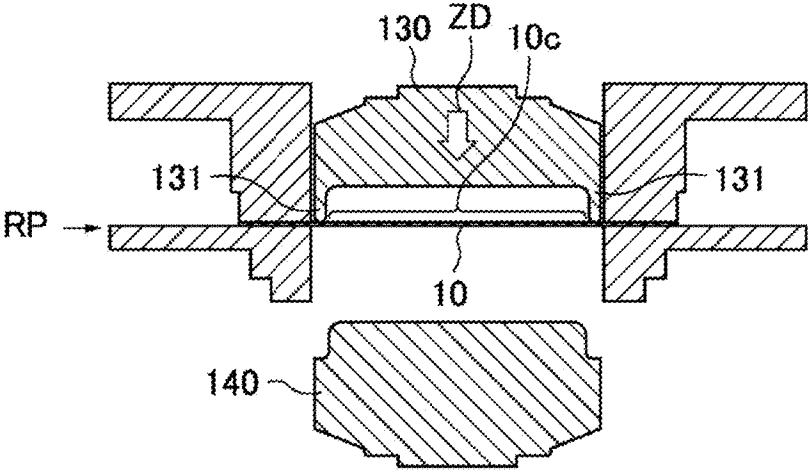

Next, as shown in FIG. 9B, the draw punch 130 is moved in the downward direction ZD, toward the blank 10. By this means, the draw punch 130 is lowered so that, for example, the tip of the annular protrusion portion 131 substantially reaches the reference position RP. By this means, the tip of the annular protrusion portion 131 is in contact with or close to the surface of the blank 10. Note that, in the state shown in FIG. 9B, the central area 10*c* of the blank 10 is located between the draw punch 130 and the plunger 140.

Figure 9C:
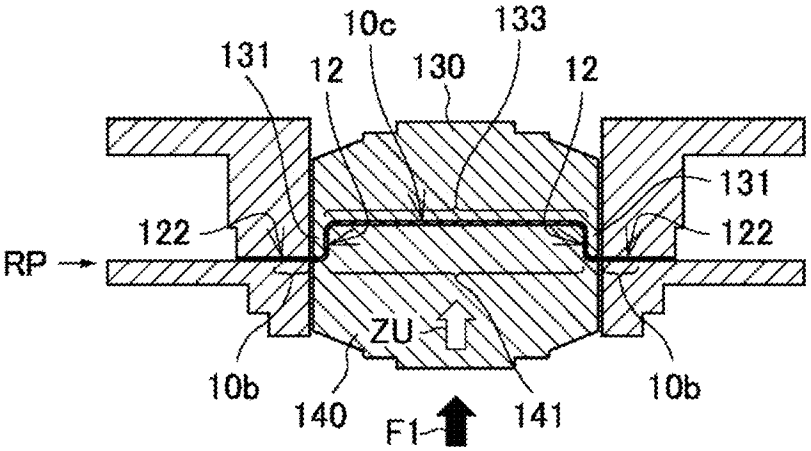

Next, as shown in FIG. 9C, the plunger 140 is moved in the upward direction ZU, toward the blank 10. By this means, the plunger 140 is lifted so that the tip of the reduced-diameter portion 141 passes the reference position RP. When the reduced-diameter portion 141 passes, for example, the reference position RP, the reduced-diameter portion 141 advances into the depression 133. By this means, the central area 10*c* of the blank 10 is pushed by the reduced-diameter portion 141 into the depression 133. The degree of the push is about 10 mm according to the present embodiment. Note that the degree of push is changed variously depending on the size of the paper lid 1, the use of the paper lid 1 and so forth.

In this manner, the central area 10*c* is pushed into the depression 133, while holding down the outer edge area 10*b* with the pressing surface 122. By this means, the inner fitting portion 12 can be formed in the central area 10*c*, by using "drawing molding", while performing "wrinkle prevention" on the outer edge area 10*b*.

Figure 12B:
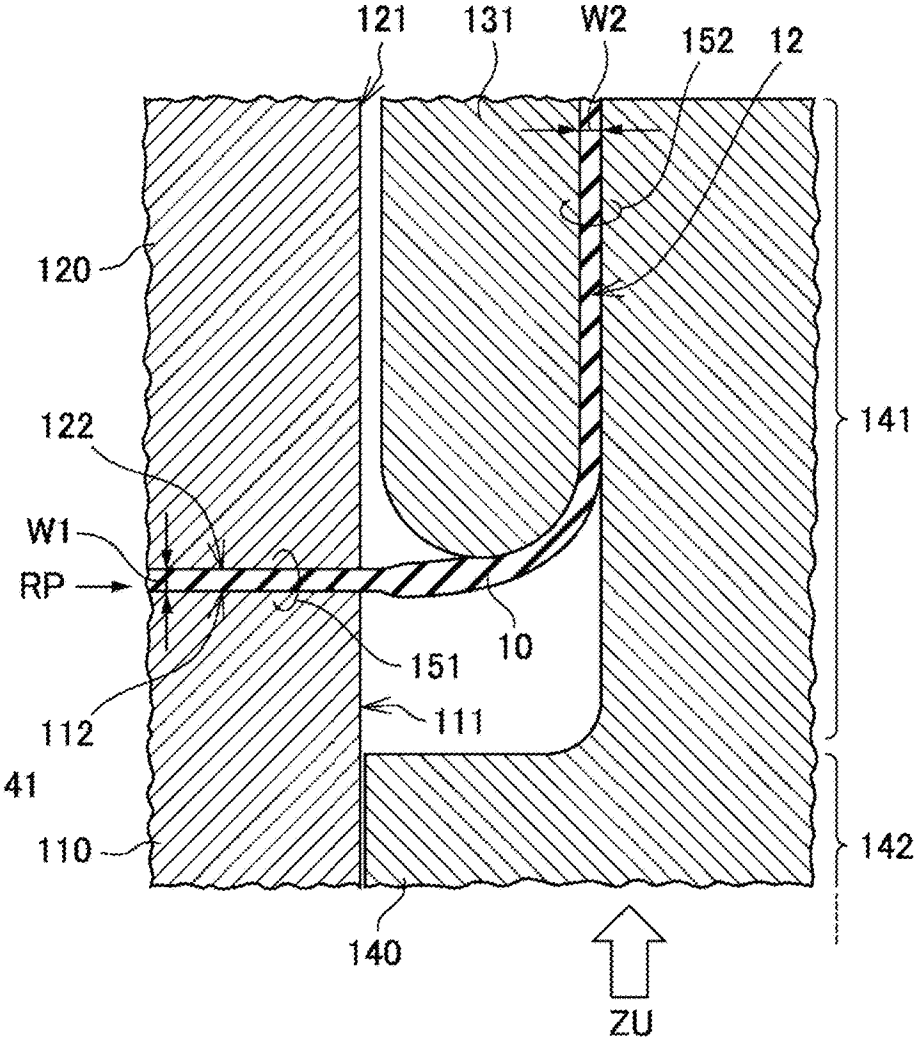
FIGS. 12A and 12B are schematic cross-sectional views to show partially enlarged views of a draw die, a blank holder, an annular protrusion portion and a plunger, respectively.
Figure 12A:
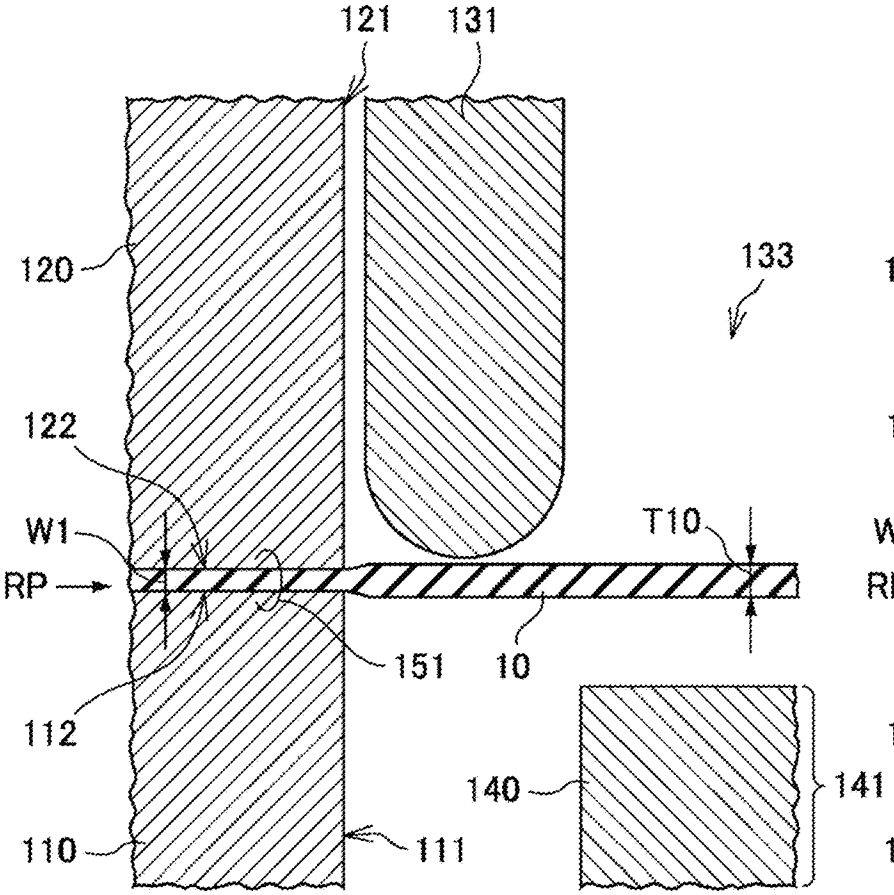

FIGS. 12A and 12B are schematic cross-sectional views to show partially enlarged views of a draw die 110, a blank holder 120, an annular protrusion portion 131 and a plunger 140, respectively. FIG. 12A shows the state before the push, and FIG. 12B shows the state during the push.

As shown in FIG. 12B, a second clearance 152 is formed between the reduced-diameter portion 141 and the annular protrusion portion 131. The width W2 of the second clearance 152 is set to be equal to the paper thickness T10 of the blank 10 (FIG. 11A) or smaller than the paper thickness T10 (W2≤T10). By this means, the inner fitting portion 12 can be formed in the central area 10*c*, by using "ironing molding", while performing "wrinkle prevention" on the outer edge area 10*b*.

Note that "drawing molding" as used in the present specification is defined as the kind of molding in which the clearances between molds (the draw die 110, the blank holder 120, the draw punch 130, and the plunger 140) are set to be equal to or greater than the paper thickness T10 of the blank 10, and the blank 10 is placed in a clearance like this and molded. Furthermore, "ironing molding" is defined as the kind of molding in which at least one clearance between molds is set smaller than the paper thickness T10, and the blank 10 is placed in this clearance and molded.

When forming the inner fitting portion 12 by using "drawing molding" or "ironing molding", a first molding load F1 is applied to the plunger 140. The direction in which the first molding load F1 is applied is the upward direction ZU. An example of the value of the first molding load F1 is, for example, approximately 3 kN. The magnitude of the first molding load F1 also changes variously, depending on the size of the paper lid 1, the use of the paper lid 1, and so forth. The first molding load F1 is applied from a loader (not shown) to the plunger. An example of the loader is a loader that applies a load to an object via an elastic body. An air cylinder is an example of such a loader. The air cylinder contains air as an elastic body. Note that the loader is also used as a moving mechanism for moving the plunger 140 in the upward direction ZU and the downward direction ZD.

Figure 9D:
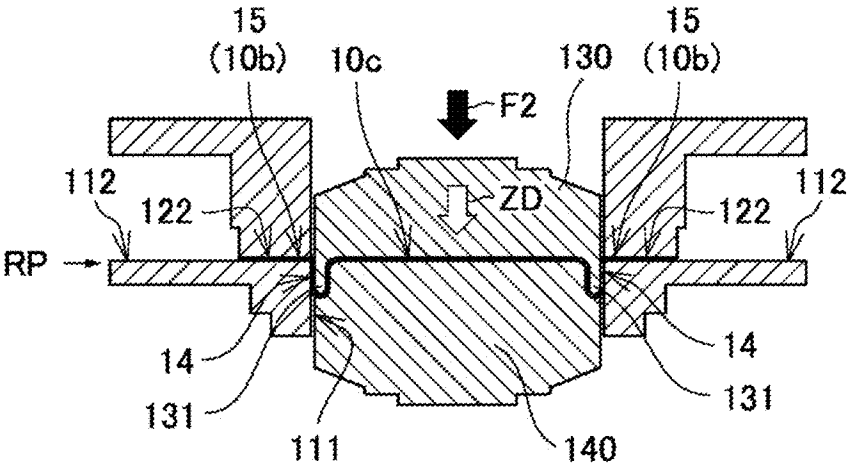

Next, as shown in FIG. 9D, the draw punch 130 is moved in the downward direction ZD, toward the blank 10. The downward direction ZD is opposite to the upward direction ZU. By this means, the draw punch 130 is lowered so that, for example, the tip of the annular protrusion portion 131 passes the reference position RP. The draw punch 130 pushes the blank 10, together with the plunger 140, into the plunger guide hole 111. The degree of the push is about 10 mm from the reference position RP, according to the present embodiment. Note that the degree of push is changed variously depending on the size of the paper lid 1, the use of the paper lid 1 and so forth.

In this manner, the central area 10*c* is pushed into the plunger guide hole 111, together with the plunger 140, while holding down the outer edge area 10*b* with the pressing surface 122. By this means, an outer fitting portion 14 can be formed in the central area 10*c*, by using "drawing molding", while performing "wrinkle prevention" on the outer edge area 10*b*. Furthermore, a flange portion 15 is formed in the outer edge area 10*b*, while the outer fitting portion 14 is formed.

Figure 13:
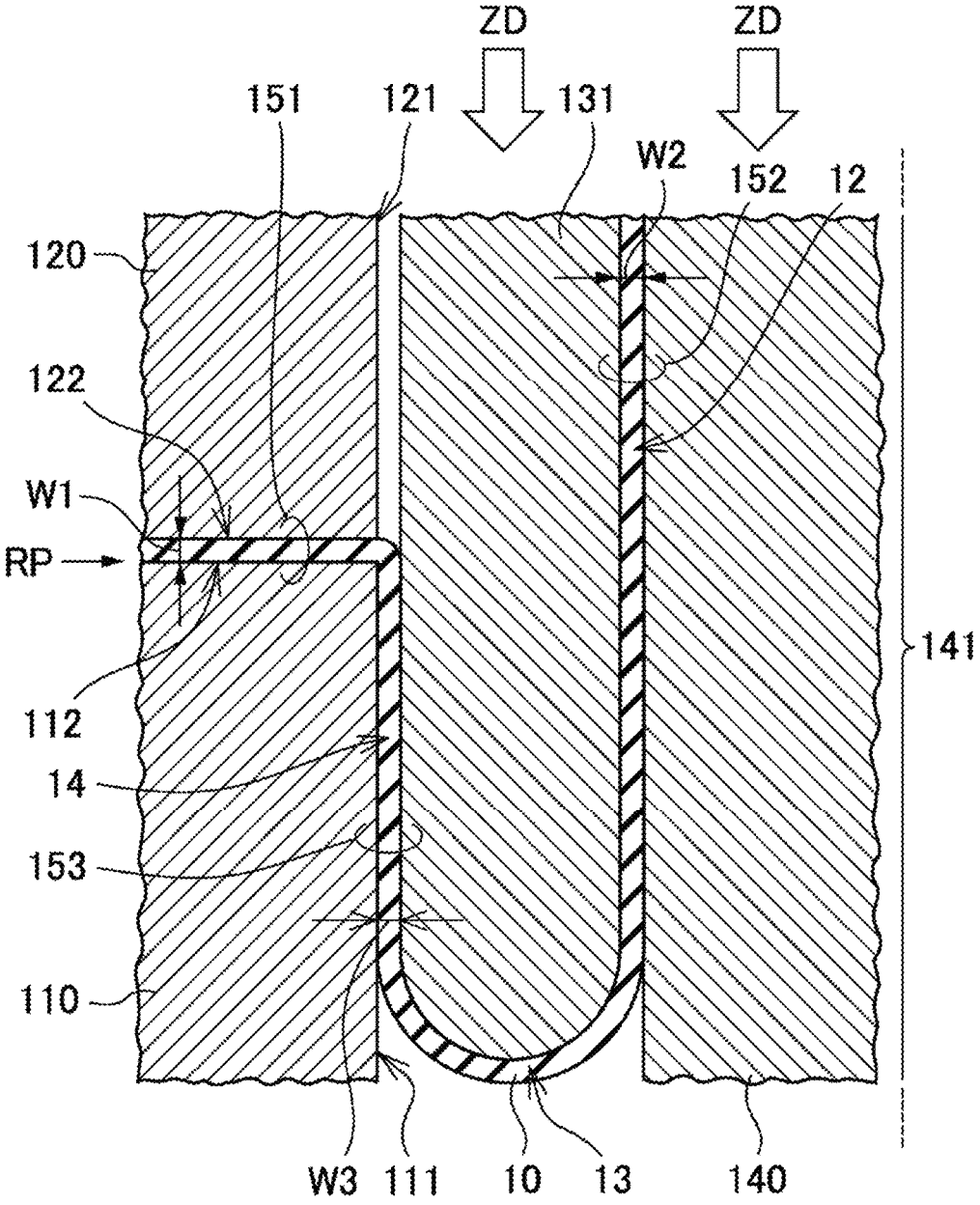
FIG. 13 is a schematic cross-sectional view to show partially enlarged views of a draw die, a blank holder, an annular protrusion portion and a reduced-diameter portion, respectively.

FIG. 13 is a schematic cross-sectional view to show partially enlarged views of a draw die 110, a blank holder 120, an annular protrusion portion 131 and a reduced-diameter portion 141, respectively. FIG. 13 shows the state after the push, or the state during the push.

As shown in FIG. 13, a third clearance 153 is formed between the annular protrusion portion 131 and the plunger guide hole 111. The width W3 of the third clearance 153 is set to be equal to the paper thickness T10 of the blank 10 (FIG. 11A) or smaller than the paper thickness T10 (W3≤T10). By this means, the outer fitting portion 14 can be formed in the central area 10*c*, by using "ironing molding", while performing "wrinkle prevention" on the outer edge area 10*b*.

When the outer fitting portion 14 is formed by using "drawing molding" or "ironing molding", a second molding load F2 is applied to the draw punch 130. The direction in which the second molding load F2 is applied is the downward direction ZD. The direction in which the second molding load F2 is applied is opposite to the direction in which the first molding load F1 is applied. An example of the value of the second molding load F2 is, for example, approximately 6.5 kN. The magnitude of the second molding load F2 also changes variously, depending on the size of the paper lid 1, the use of the paper lid 1, and so forth. The second molding load F2 is applied from a loader (not shown) to the plunger. An example of the loader is a loader that can apply a load to an object in a mechanical way. A servo press is an example of such a loader. The servo press includes a servo motor. Note that the loader is also used as a moving mechanism for moving the draw punch 130 in the downward direction ZD and the upward direction ZU. Furthermore, when a servo motor is used, for example, it is possible to control the lowering of the draw punch 130 precisely, in two steps. The first stage is the descent to the reference position RP, and the second stage is more precise descent beyond the reference position RP, down to the final descent position. With a servomotor, the draw punch 130 can be reliably stopped and kept at the final descent position.

The magnitude of the second molding load F2 may be greater than the first molding load F1. In this case, if the plunger 140 is supported by a moving mechanism including an elastic body such as an air cylinder, or by a loader, the difference between the second molding load F2 and the first molding load F1 can press down the plunger 140. Consequently, the tip of the annular protrusion portion 131 can be pushed into the plunger guide hole 111, while maintaining the state in which the molds are clamped (the state in which the central area 10*b* is sandwiched between the draw punch 130 and the plunger 140). Moreover, since the plunger 140 is pressed down by the draw punch 130, the advantage of making it unnecessary to control the position of the plunger 140 can be achieved.

When the outer fitting portion 14 is formed, the central area 10*c* is pushed into the plunger guide hole 111, together with the plunger 140 while leaving the outer edge area 10*b* between the mounting surface 112 and the pressing surface 122. By this means, the flange portion 15 can be formed in the outer edge area 10*b* of the paper lid 1. If the paper lid 1 has a flange portion 15, the paper lid 1 can be removed as follows, during the process of removing the paper lid 1.

Figure 10B:
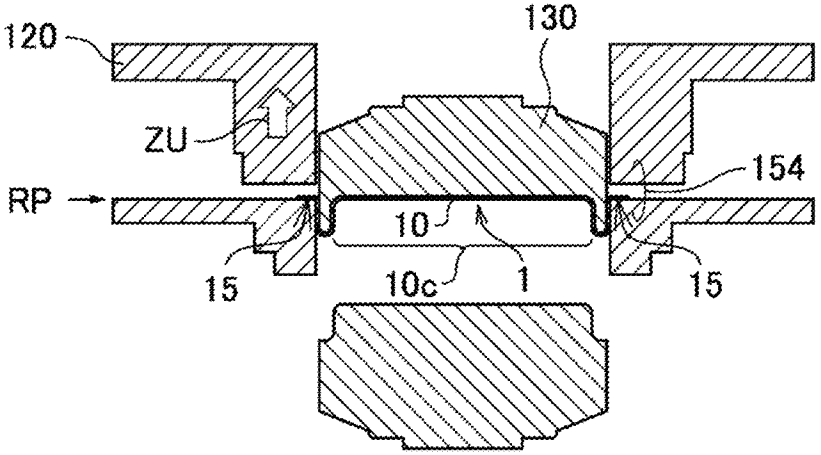
Figure 10B:
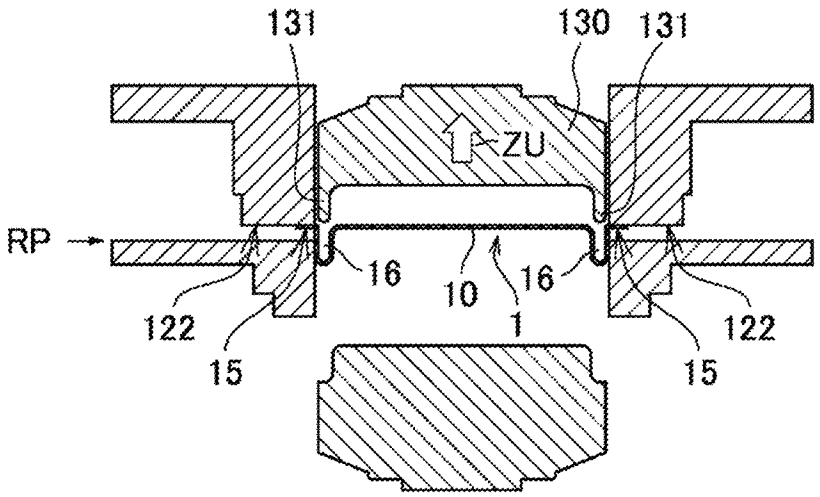
Figure 10A:
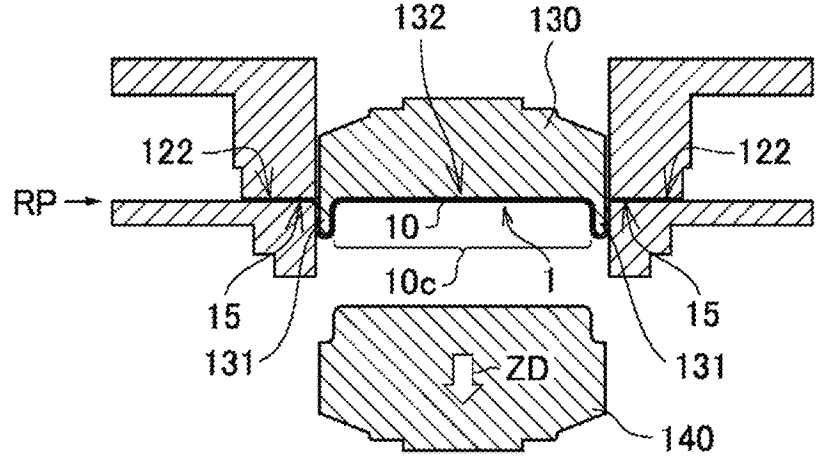
Figure 10A:
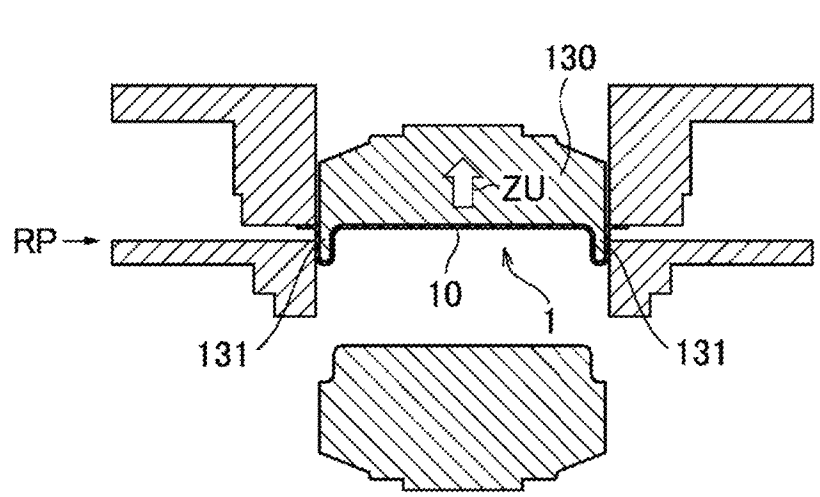

As shown in FIG. 10A, the plunger 140 is moved in the downward direction ZD, while holding down the flange portion 15 with the pressing surface 122. By this means, the plunger 140 is parted from the paper lid 1. The draw punch 130 is kept at the final descent position. Consequently, the draw punch 130 stays in contact with, for example, the central area 10*c*. If the draw punch 130 is kept at the final descent position, the paper lid 1 will not fall even if the plunger 140 parts from the paper lid 1.

Next, as shown in FIG. 10B, the blank holder 120 is moved in the upward direction ZU while holding the draw punch 130 at the final descent position. By this means, the blank holder 120 is parted from the paper lid 1. Then, the blank holder 120 is placed in idle state with a fourth clearance 154 formed between the flange portion 15 and the pressing surface 122.

Next, as shown in FIG. 10C, the draw punch 130 is moved in the upward direction ZU. At this time, the annular protrusion portion 131 is often stuck into the annular recess portion 16. If the annular protrusion portion 131 is stuck into the annular recess portion 16, the paper lid 1 moves in the upward direction ZU while being stuck to the draw punch 130.

Next, as shown in FIG. 10D, the draw punch 130 is moved further in the upward direction ZU. By moving the draw punch 130 further in the upward direction ZU, it is possible to bring the flange portion 15 into contact with the pressing surface 122 again. The annular protrusion portion 131 is pulled out of the annular recess portion 16, while the flange portion 15 is supported by the pressing surface 122. Eventually, the paper lid 1 parts from the draw punch 130. By this means, the paper lid 1 is ready to be removed from the processing machine 100.

In this way, the outer fitting portion 14 is formed in the central area 10*c*, while leaving the outer edge area 10*b* between the mounting surface 112 and the pressing surface 122, so that the flange portion 15 can be formed in the paper lid 1. In addition, the blank holder 120 is placed in idle state with the fourth clearance 154 formed between the flange portion 15 and the pressing surface 122, and the flange portion 15 is brought into contact with the pressing surface 122 again, so that, even if the annular protrusion portion 131 is stuck into the annular recess portion 16, the paper lid 1 can be easily removed from the draw punch 130. It is not necessary to provide a removal mechanism for parting the paper lid 1, such as a knockout, in the draw punch 130.

By following such a production method, a top plate portion 11, an inner fitting portion 12, a peak portion 13, an outer fitting portion 14, and a flange portion 15 can be formed in a paper lid 1.

Hereinafter, an example of the paper lid 1 will be described in more detail.

<Shape of Inclined Portion>

Figure 14:
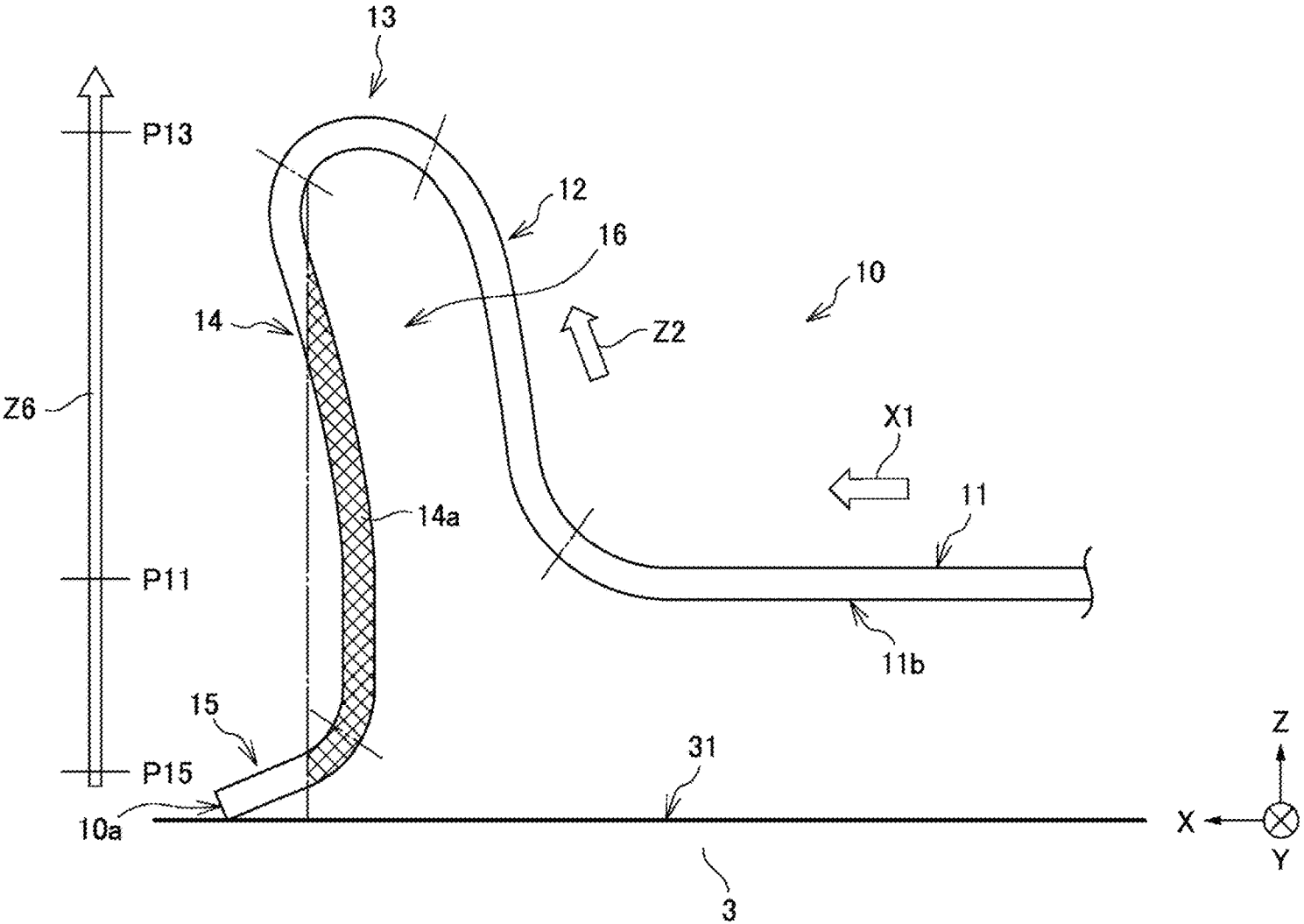
FIG. 14 is a schematic cross-sectional view to show an example of a paper lid according to one embodiment of this invention.

FIG. 14 is a schematic cross-sectional view to show an example of a paper lid according to one embodiment of this invention. The cross section shown in FIG. 14 corresponds to the cross section shown in FIG. 2, for example.

As shown in FIG. 14, with the paper lid 1 according to one embodiment, at least a part of the outer fitting portion 14 has an inclined portion 14*a* that is inclined toward the inner fitting portion 12 side. In the paper lid 1, the inclined portion 14*a* is provided all around the outer fitting portion 14.

Figure 15A:
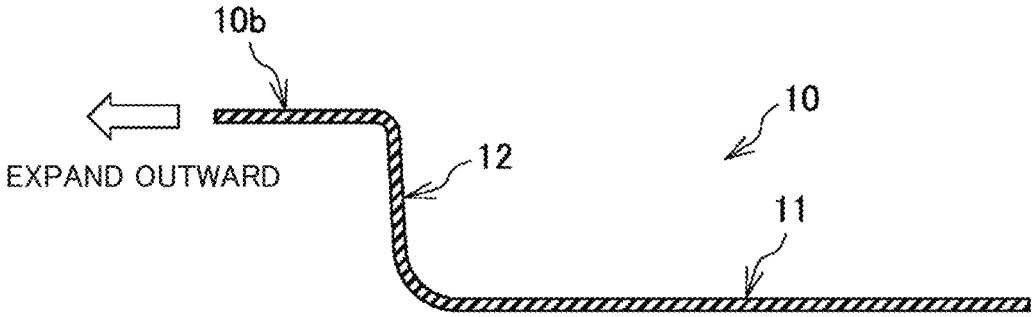
FIGS. 15A to 15C are schematic cross-sectional views to show examples of a paper lid according to one embodiment in the order of producing steps.
Figure 15B:
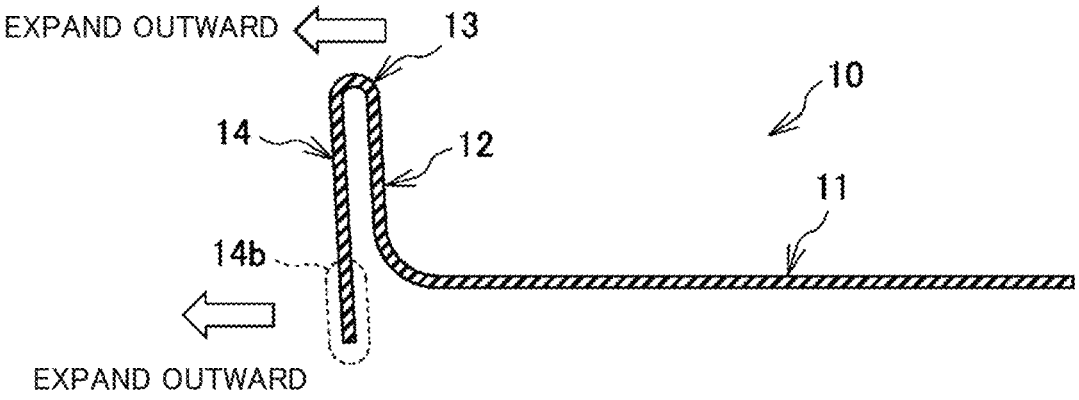
Figure 15C:
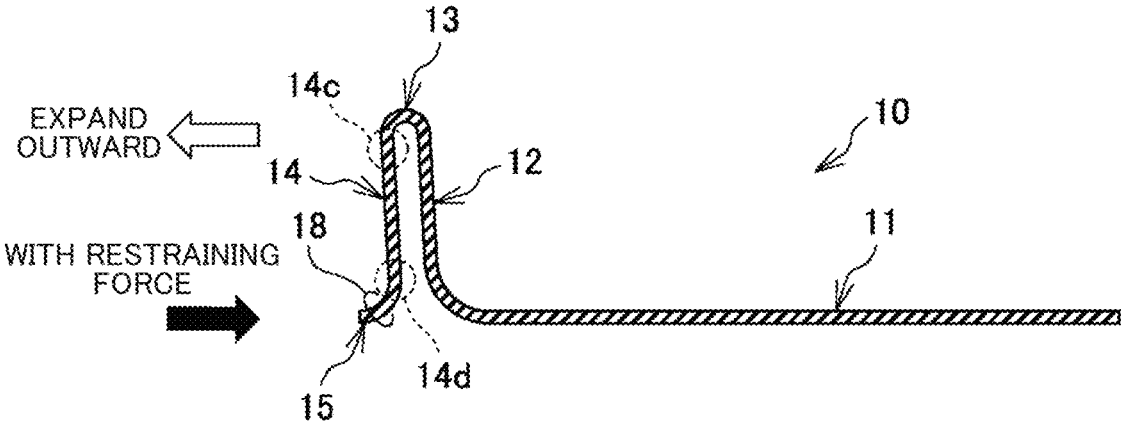

FIGS. 15A to 15C are schematic cross-sectional views to show examples of a paper lid according to one embodiment in the order of producing steps.

As shown in FIG. 15A, the inner fitting portion 12 is alone subjected to "drawing molding", after the molds are removed, the skirt portion of the blank 10 (which, for example, corresponds to the outer edge area 10*b*) usually expands outward (or tries to resume its original flat shape) due to the residual stress.

Next, as shown in FIG. 15B, when the inner fitting portion 12 and the outer fitting portion 14 are molded, after the molds are removed, the inner fitting portion 12 tries to expand outward, and the hem 14*b* of the outer fitting portion 14 comes below the peak portion 13, relatively. Here, without the flange portion 15, the outer fitting portion 14 would try to resume the shape shown in FIG. 15A. Consequently, the hem 14*b* that once came below the peak portion 13 moves out from below the peak portion 13. The state in which the hem 14*b* is below the peak portion 13 cannot be maintained.

Consequently, as shown in FIG. 15C, the hem 14*b* is kept in in a flange shape, and the flange portion 15 is formed in the paper lid 1. Furthermore, the flange portion 15 has wrinkles, which are compressed and crushed more by the effect of wrinkle prevention. Since the flange portion 15 is compressed, a force to try to stay in that shape acts on the flange portion 15. Furthermore, given that the flange portion 15 is provided along the entire circumferential direction, a force to fix the entire circumference is produced, so that the outer fitting portion 14 is prevented from resuming the shape shown in FIG. 15A. However, no force to act against outward-expanding force acts on the upper portion 14*c* of the outer fitting portion 14. Consequently, the upper portion 14*c* expands outward. By contrast with this, to the lower portion 14*d* of the outer fitting portion 14, a force to act against outward-expanding force acts by means of the flange portion 15. Consequently, the lower portion 14*d* is less likely to expand outward. As a result of this, the state in which the hem 14*b* is below the peak portion 13 can be maintained. By this means, the outer fitting portion 14 can be provided with an inclined portion 14*a*, and the inner fitting portion 12 can be inclined toward the outer fitting portion 14 side.

With this paper lid 1, the outer fitting portion 14 has an inclined portion 14*a*, so that the paper lid 1 can be fitted to the paper container 2 firmly compared to a paper lid without an inclined portion 14*a*. It then follows that the paper lid 1 can be made even less likely to come off from the paper container 2 easily.

Also, the inclined portion 14*a* is formed with a curved surface that is convex toward the inner fitting portion 12 side. With this paper lid 1, the curved surface of the inclined portion 14*a* fits the fingertip of a person, which makes the paper lid 1 more comfortable to grip. It then follows that, even when the paper lid 1 fits with the paper container 2 firmly, the advantage of making the paper lid 1 easy to remove from the paper container 2 can still be achieved.

Moreover, by providing the inclined portion 14*a* all around the outer fitting portion 14, the strength with which the paper lid 1 and the paper container 2 fit together can be increased even more, compared to a paper lid without an inclined portion 14*a* provided all around the outer fitting portion 14.

Furthermore, as shown in FIG. 14, with the paper lid 1 according to one embodiment, in the sixth direction Z6, which is orthogonal to the first direction X1, the position P11 of the top plate portion 11 is between the position P13 of the peak portion 13 and the position P15 of the flange portion 15.

Given such a paper lid 1, even if the paper lid 1 is placed on a table 3, the container-side surface 11*b* does not contact the table surface 31. This paper lid is hygienic.

In addition, the peak portion 13 includes a curved surface that is convex in the second direction Z2. After a curl portion 22 moves into the annular recess portion 16, the peak portion 13 presses the outer fitting portion 14 against the curl portion 22 (see FIG. 2). Consequently, the paper lid 1 can be fitted to the paper container 2 even more firmly.

<Relationship Between Height of Inner Fitting Portion 12 and Outer Diameter of Outer Fitting Portion 14>

FIG. 16A is a schematic cross-sectional view to show an example of a paper lid according to one embodiment of this invention. FIG. 16B is a schematic cross-sectional view to show a paper container that can fit an example of a paper lid according to one embodiment of this invention.

Assume that the paper container 2 contains liquid contents, and the paper container 2 containing liquid is covered with a paper lid 1. Given this assumption, for example, when the paper container 2 falls down, the liquid may leak if the inner fitting portion 12 is shallow. So, the present inventors have studied what height the inner fitting portion 12 should have to prevent the liquid from leaking even when the paper container 2 collapses or is left collapsed for a long time.

As shown in FIG. 16A and FIG. 16B, the height H of the inner fitting portion 12 refers to the height H from the top surface 11*a* of the top plate portion 11 to the peak of the peak portion 13. Note that the height of the portion that actually functions as a seal (the height from the deepest contact point where the inner fitting portion 12 contacts the inner peripheral surface 21 of the container portion, to the peak of the curl portion 22) is really supposed to be selected as the height of the inner fitting portion 12. However, as can be determined from the paper lid 1, the height of the inner fitting portion 12 is set as described above for convenience. Although the height H is different from the height of the portion that actually functions as a seal, the difference is slight, and so these are substantially equal.

Figure 17:
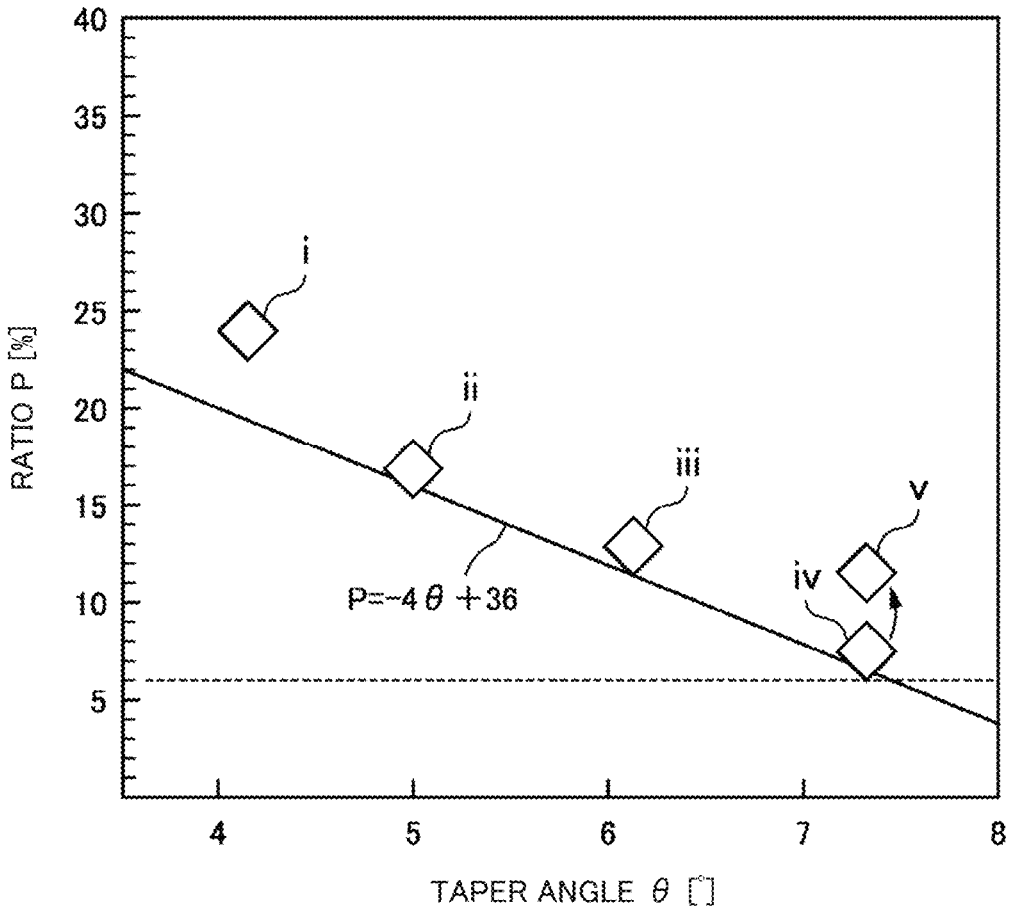
FIG. 17 is a diagram to show the relationship between the taper angle and the ratio.

FIG. 17 is a diagram to show the relationship between the taper angle θ and the proportion P. The taper angle θ is the angle at which the side surface of the paper container 2 expands outward. The taper angle θ is, for example, the angle of inclination from the perpendicular line 24 with respect to the container bottom plate 23 of the paper container 2. The proportion P is the ratio of the height H to the outer diameter D of the outer fitting portion 14 (P=(H/D)×100%).

As shown in FIG. 17, the present inventors have conducted the leak test of the paper lid 1, for each taper angle θ. The contents were coffee (temperature is 5° C.±2° C.). The angle of inclination of the paper container 2 was 90° (placed on the side). The paper container 2 containing the contents was held for 60 seconds while being inclined by 90°.

In the leak test, the following three states of the contents were observed.

Poor: leakage

Good: slight bleeding inside the annular recess portion 16, but no leakage

Excellent: no leakage or bleeding

When the paper lid 1 is in the state "Good" or the state "Excellent", it is possible to prevent the contents from leaking even if the paper container 2 falls down, and therefore the paper lid 1 is more practical.

The points (where the symbol "◇" is shown) plotted in FIG. 17 show the proportion P in the state "Good". When the taper angle θ was about 4°15', the proportion P was approximately 23.8%, and the state was "Good" (see "i"). When the taper angle θ was about 5°, the proportion P was approximately 17.1%, and the state was "Good" (see "ii"). When the taper angle θ was about 6°15', the proportion P was approximately 13.1%, and the state was "Good" (see "iii"). When the taper angle θ was about 7°30', the proportion P was approximately 7.7%, and the state was "Good" (see "iv").

Note that the leak test took as long a time as as 60 seconds. Consequently, in actual use, the proportion P may be allowed to vary, for example, by approximately −2% from the above values.

From the result of the leak test, if the proportion P of the height H to the outer diameter D of the outer fitting portion 14 (P=(H/D)×100%) is at least approximately 6%, it is possible to prevent leakage of contents even if the paper container 2 falls down.

In this way, the paper lid 1 having a proportion P of at least 6% may be produced, and the paper container 2 suitable for the paper lid 1 may be selected.

The proportion P can be set to the above values or even higher. For example, if the proportion P is increased to approximately 11.6% when the taper angle θ is approximately 7°30', the state of the contents can be changed from the state of "Good" to the state of "Excellent" (see "v"). If the state is "Excellent", it is possible to have a paper lid 1 that can prevent both leakage and bleeding even if the paper container 2 falls down. As for the upper limit of the proportion P, a reasonable value has only to be selected. To give one example, the upper limit of the proportion P would be approximately 100%. In this case, the height H is almost equal to the outer diameter D.

<Combination of Paper Lid 1 and Paper Container 2>

Also, from the leak test, it was confirmed that the proportion P where the state of "Poor" can shift to the state of "Good" tended to increase as the taper angle θ was closer to 0°. The combination of the paper lid 1 and the paper container 2 may be optimized as follows, for example.

When the taper angle of the container (for example, the paper container 2) fitted into the paper lid 1 is 0, a value that is equal to or greater than the value derived from the following equation 1:

$$P=-4\theta+36 \quad \text{(Equation 1)}$$

is selected for the value of the proportion P (P=(H/D)×100).

In this way, by selecting the proportion P of the paper lid 1 depending on the taper angle θ of the paper container 2, a paper lid 1 that is optimal for the paper container 2 can be selected.

<Relationship Between Outer Diameter D22 of Paper Container 2 and Outer Diameter D of Outer Fitting Portion 14>

The outer diameter D22 of the paper container 2 may be larger than the outer diameter D of the outer fitting portion 14. In this case, the outer diameter D15 of the flange portion 15 is preferably larger than the outer diameter D22.

Furthermore, when the flange portion 15 is placed on a flat surface (for example, the table 3), it is preferable to make the flange portion 15 rise upward from the table surface 31 (see FIG. 14). That is, as shown in FIG. 16, the fifth direction X5, in which the flange portion 15 extends, intersects the virtual line 10*d* connecting between the ends 10*a* of the paper lid 1, and is oriented to face the paper container 2. By doing so, even if the outer diameter D22 is larger than the outer diameter D, the flange portion 15 guides the curl portion 22 into the annular recess portion 16. The flange portion 15 functions as a guide for the curl portion 22. In this way, the outer fitting portion 14 is fitted to the paper container 2 having an outer diameter D22 that is larger than the outer diameter D, so that the outer fitting force of the paper lid 1 can be increased even more.

Furthermore, the peak portion 13 preferably has a curved surface that is convex in the second direction Z2. The peak portion 13 has such a curved surface, so that, when the curl portion 22 is guided by the flange portion 15 into the annular recess portion 16, the outer fitting portion 14 easily expands outward. Consequently, the paper lid 1 can be easily attached to the paper container 2.

Moreover, the peak portion 13 with a curved surface that is convex in the second direction Z2 presses the outer fitting portion 14 against the curl portion 22 after the curl portion 22 moves into the annular recess portion 16. Consequently, the paper lid 1 can also be fitted to the paper container 2 even more firmly.

The paper lid 1 is used, for example, as a lid for the paper container 2. The paper container 2 may contain liquid, for example. Consequently, the paper to use for the paper lid 1 is preferably water-repellent paper, or paper with a surface subjected to water-repellent finishing. Also, laminated paper, in which resin is laminated on the surface of the paper, coated paper that is coated with resin and so forth may be used. However, the paper to use for the paper lid 1 can be changed as appropriate depending on the needs of consumers. The paper to use for the paper lid 1 is therefore not limited to water-repellent paper, or paper with a surface subjected to water-repellent finishing. Furthermore, a drinking hole may be formed in the top plate portion 11 of the paper lid 1.

According to one embodiment like this, it is possible to provide a paper lid that has both an inner fitting portion 12 and an outer fitting portion 14, and that does not easily come off the container (for example, the paper container 2).

Now, although an embodiment of the present invention has been described above, the embodiment has been presented simply by way of example, and is not intended to limit the scope of the invention. Furthermore, the above embodiment is not the only embodiment of this invention. Furthermore, this invention can be implemented in a variety of new forms other than the above embodiment. Accordingly, a variety of omissions, replacements, changes and so forth can be applied to the above embodiment without departing from the spirit of the present invention. Such new forms and changes are included in the scope and spirit of this invention, and are also included in the scope of the invention described in the claims and equivalents of the invention recited in the claims.

REFERENCE SIGNS LIST

1: paper lid
10: blank
10*a*: end
10*b*: outer edge area
10*c*: central area
10*d*: virtual line
10*e*: corner portion
11: top plate portion
11*a*: top surface
11*b*: container-side surface
12: inner fitting portion
13: peak portion
14: outer fitting portion
14*a*: inclined portion
14*b*: hem
14*c*: upper portion of outer fitting portion
14*d*: lower portion of outer fitting portion
15: flange portion
16: annular recess portion
17: wrinkles
18: shoulder portion
1*a*: paper lid (reference example)
2: paper container
21: inner peripheral surface of container portion
22: outer peripheral surface of the curl portion
23: bottom plate of container portion
3: table
31: table surface
100: processing machine
110: draw die
111: plunger guide hole
112: mounting surface
120: blank holder
121: punch guide hole
122: pressing surface
130: draw punch
131: annular protrusion portion
132: punch surface
133: depression
140: plunger
141: reduced-diameter portion
142: base diameter portion
151: first clearance
152: second clearance
153: third clearance
OEP: outer edge portion
X1: first direction
Z2: second direction
X3: third direction
Z4: fourth direction
X5: fifth direction
Z6: sixth direction
F1: first molding load
F2: second molding load
ZU: upward direction
ZD: downward direction
D1: diameter of reduced-diameter portion 141
D2: diameter of base diameter portion 142
T10: paper thickness
W1: width of first clearance
W2: width of second clearance
W3: width of third clearance
RP: reference position
P11: position of top plate portion
P13: position of peak portion
P15: position of flange portion
H: height from top surface 11*a* to top 13*a*
D: outer diameter of outer fitting portion 14
D22: outer diameter of the paper container 2
D15: outer diameter of flange portion 15
P: proportion SD: shooting direction

The invention claimed is:

1. A paper lid mainly made of paper, the paper lid comprising:

a top plate portion, extending in a first direction;

an inner fitting portion, provided along a circumferential direction of the top plate portion, extending in a second direction, which intersects the first direction, and being continuous with the top plate portion;

a peak portion, provided along a circumferential direction of the inner fitting portion, extending in a third direction, which intersects the second direction, and being continuous with the inner fitting portion;

an outer fitting portion, provided along a circumferential direction of the peak portion, extending in a fourth direction, which intersects the third direction, and being continuous with the peak portion; and a flange portion, provided along a circumferential direction of the outer fitting portion, extending in a fifth direction, which intersects the fourth direction, being continuous with the outer fitting portion, and including an end of the paper lid, wherein:

an inner-surface side of the inner fitting portion faces an inner-surface side of the outer fitting portion with a space therebetween, the paper lid is configured to fit to a paper container by receiving the paper container at least in the space provided between the inner fitting portion and the outer fitting portion, the inner-surface side of the inner fitting portion contacts with an inner peripheral surface of the paper container when the paper container is received in the space between the inner fitting portion and the outer fitting portion, the inner-surface side of the inner fitting portion has no wrinkles in a first part of a range thereof starting from the top plate portion, the first part opposing the inner-surface side of the outer fitting portion along the first direction, and has wrinkles in a second part of the range extending from the first part, the peak portion has wrinkles, and a tip of the flange portion has wrinkles.

2. The paper lid according to claim 1, wherein the outer fitting portion has an inclined portion, in which at least a part of the outer fitting portion is inclined toward an inner fitting portion side.

3. The paper lid according to claim 1, wherein a first distance measured from a top surface of the top plate portion to a peak of the peak portion is at least 6% of a second distance measured across an outer diameter of the outer fitting portion.

4. The paper lid according to claim 1, wherein in a sixth direction, which is orthogonal to the first direction, the top plate portion is located between a position of the peak portion and a position of the flange portion.

5. The paper lid according to claim 2, wherein a first distance measured from a top surface of the top plate portion to a peak of the peak portion is at least 6% of a second distance measured across an outer diameter of the outer fitting portion.

6. The paper lid according to claim 2, wherein in a sixth direction, which is orthogonal to the first direction, the top plate portion is located between a position of the peak portion and a position of the flange portion.

7. The paper lid according to claim 3, wherein in a sixth direction, which is orthogonal to the first direction, the top plate portion is located between a position of the peak portion and a position of the flange portion.

* * * * *